US010040266B2

(12) United States Patent
Ohira et al.

(10) Patent No.: US 10,040,266 B2
(45) Date of Patent: Aug. 7, 2018

(54) GLUE APPLICATION DEVICE AND GLUE APPLICATION METHOD FOR CARDBOARD SHEETS AND CARDBOARD SHEET MANUFACTURING DEVICE

(71) Applicant: MITSUBISHI HEAVY INDUSTRIES MACHINERY SYSTEMS, LTD., Hyogo (JP)

(72) Inventors: Kazuhito Ohira, Mihara (JP); Kazuki Mizushima, Mihara (JP)

(73) Assignee: MITSUBISHI HEAVY INDUSTRIES MACHINERY SYSTEMS, LTD., Hyogo (JP)

( * ) Notice: Subject to any disclaimer, the term of this patent is extended or adjusted under 35 U.S.C. 154(b) by 350 days.

(21) Appl. No.: 14/761,295

(22) PCT Filed: Dec. 12, 2013

(86) PCT No.: PCT/JP2013/083383
§ 371 (c)(1),
(2) Date: Jul. 15, 2015

(87) PCT Pub. No.: WO2014/129057
PCT Pub. Date: Aug. 28, 2014

(65) Prior Publication Data

US 2015/0360436 A1 Dec. 17, 2015

(30) Foreign Application Priority Data

Feb. 20, 2013 (JP) ..... 2013/031549

(51) Int. Cl.
*B31F 1/24* (2006.01)
*B31F 1/28* (2006.01)

(52) U.S. Cl.
CPC ..... *B31F 1/24* (2013.01); *B31F 1/28* (2013.01); *B31F 1/2818* (2013.01); *Y10T 156/1052* (2015.01)

(58) Field of Classification Search
CPC .. B31F 1/24; B31F 1/28; B31F 1/2818; Y10T 156/1052
See application file for complete search history.

(56) References Cited

U.S. PATENT DOCUMENTS 4,338,881 A * 7/1982 Tokuno ..... B31F 1/2818 118/249
5,101,761 A 4/1992 Isowa et al.
(Continued)

FOREIGN PATENT DOCUMENTS

EP 0599062 A1 6/1994
EP 2060388 A2 5/2009
(Continued)

OTHER PUBLICATIONS

International Search Report dated Mar. 18, 2014, corresponding to International Application No. PCT/JP2013/083383.
(Continued)

*Primary Examiner* — Mark A Osele
*Assistant Examiner* — Christopher C Caillouet
(74) *Attorney, Agent, or Firm* — Hauptman Ham, LLP

(57) ABSTRACT

A device includes a tank for storing a glue solution; a roll having a surface for transferring the glue solution onto an area of a corrugating medium of a single-faced corrugated fiberboard sheet in the width direction; scraping members for regulating adhesion of the glue solution outside the area on the surface of the roll; a movement mechanism for moving the scraping members in the width direction; and a control device for setting, on the basis of the cutting width dimension with which the double-faced cardboard sheet is to
(Continued)

be cut after passing the roll, the area to be a region in which margins in the width direction have been added outside positions of the side edges of the cutting width dimension, and for controlling the movement mechanism to dispose the scraping members at positions corresponding to the positions of the side edges of the glue application region.

6 Claims, 8 Drawing Sheets

(56) References Cited

U.S. PATENT DOCUMENTS

| | | | | |
|---|---|---|---|---|
| 5,518,573 | A | 5/1996 | Schulz | |
| 7,832,441 | B2 | 11/2010 | Titz | |
| 2003/0183334 | A1* | 10/2003 | Sjoberg | B32B 38/1841 156/307.3 |

FOREIGN PATENT DOCUMENTS

| | | | |
|---|---|---|---|
| JP | 3-150 | A | 1/1991 |
| JP | 7-100976 | A | 4/1995 |
| JP | 7-136581 | A | 5/1995 |
| JP | 8-258187 | A | 10/1996 |
| JP | 10-29251 | A | 2/1998 |
| JP | 2004-148580 | A | 5/2004 |
| JP | 2011-212919 | A | 10/2011 |

OTHER PUBLICATIONS

Office Action in JP Application No. 2013-031549, dated Dec. 6, 2016.

Extended European Search Report in EP Application No. 13875910.5, dated Nov. 15, 2016.

Information Statement submitted Oct. 28, 2014 by the third party, corresponding to Japanese patent application No. 2013-31549.

Written Opinion dated Mar. 18, 2014, corresponding to International patent application No. PCT/JP2013/083383.

* cited by examiner

GLUE APPLICATION DEVICE AND GLUE APPLICATION METHOD FOR CARDBOARD SHEETS AND CARDBOARD SHEET MANUFACTURING DEVICE

RELATED APPLICATIONS

The present application is a National Stage of PCT International Application No. PCT/JP2013/083383, filed Dec. 12, 2013, which claims the benefit of priority from Japanese Patent Application No. 2013-031549, filed Feb. 20, 2013.

TECHNICAL FIELD

The present invention relates to a glue application device and a glue application method for corrugated fiberboards that makes a glue solution adhere to apexes of a waveform of a corrugating medium when a liner is stuck onto the corrugating medium subjected to waveform processing to form a corrugated fiberboard, and a corrugated fiberboard manufacturing device that sticks a liner onto a corrugating medium subjected to waveform processing to manufacture a corrugated fiberboard.

BACKGROUND ART

Corrugating machines as corrugated fiberboard manufacturing devices include a single facer that forms a single-faced corrugated fiberboard, and a double facer that sticks bottom linerboard paper onto a single-faced corrugated fiberboard to form a double-faced corrugated fiberboard. The single facer performs waveform processing of corrugated paper (corrugating medium) supplied from a mill roll stand, and sticks a top linerboard supplied from another mill roll stand onto the corrugated paper to form a single-faced corrugated fiberboard. The single-faced corrugated fiberboard formed by the single facer is sent to a bridge provided on the downstream side, and is sent to the double facer on the downstream side in accordance with the speed thereof while being stored in the bridge. The double facer sticks a bottom linerboard, which is sent from a mill roll stand separately provided, onto the single-faced corrugated fiberboard sent from the bridge, and forms a double-faced corrugated fiberboard. After predetermined slits or predetermined ruled lines are formed in a conveying direction by slitter scorers in the double-faced corrugated fiberboard that has passed through this double facer, the double-faced corrugated fiberboard is cut into corrugated fiberboards in the width direction by a cutter device, and the cut corrugated fiberboards are stacked on a stacker and are discharged sequentially.

In this corrugating machine, since the single facer sticks the top linerboard onto the corrugating medium to form the single-faced corrugated fiberboard, a glue application device that applies a glue solution to apexes of a waveform of the corrugating medium is provided. Additionally, since the double facer sticks the bottom linerboard onto the corrugating medium of the single-faced corrugated fiberboard formed by the single facer to form the double-faced corrugated fiberboard, a glue application device that applies the glue solution to the apexes of the waveform of the corrugating medium (single-faced corrugated fiberboard) is provided. These glue application devices make the glue solution stored in the glue solution tank adhere to the glue application roll, adjust the glue solution adhered to this glue application roll to a set film thickness with a doctor roll, and then transfer the glue solution on the glue application roll to the apexes of the corrugating medium.

In the related art, for example, a glue application device (liquid transfer device) described in PTL 1 includes regulating parts that are disposed apart from each other in an axial direction of an applicator roll as a glue application roll inside a glue solution tank, and block valley portions that commonly abut against opposed peripheral surfaces of a doctor roll and the applicator roll and are defined near contact portions of both the rolls, to a pair of damming plates capable of being brought close to and separated from each other. This glue application device adjusts the positions of the damming plates in accordance with the width dimension of a corrugating medium, and prevents surplus glue solution from adhering to regions longer than the width dimension of the corrugating medium.

Additionally, for example, a glue application device (a glue application device of a single facer) described in PTL 2 presets the positions of glue dams (equivalent to the damming plates described in PTL 1), on the basis of data regarding the positions of paper edges of a corrugating medium. This glue application device precisely aligns the positions of the glue dams with paper end positions of the corrugating medium so as to always obtain an optimum glue application width.

Additionally, for example, a fabric application method described in PTL 3 detects left and right lug edge locations of fabric that travels before application, respectively, and moves side plates independently in accordance with the amount of displacement of the lug edges, respectively such that the side plates (equivalent to damming plates described in PTL 1) are located inside of the lug edges by predetermined amounts.

CITATION LIST

Patent Literature

[PTL 1] Japanese Unexamined Patent Application Publication No. 3-150

[PTL 2] Japanese Unexamined Patent Application Publication No. 2004-148580

[PTL 3] Japanese Unexamined Patent Application Publication No. 7-136581

SUMMARY OF INVENTION

Technical Problem

As illustrated in PTL 1 to PTL 3, preventing adhesion of surplus glue solution to a glue application roll is well-known. However, the side edges of the corrugated fiberboard are cut so as to have predetermined width dimensions after the top linerboard or the bottom linerboard is stuck on the corrugating medium with the glue solution. In such a case, in the devices and the method described in PTL 1 to PTL 3, since the glue solution is also transferred to unnecessary edge pieces (generally referred to as trims) that are cut, the glue solution is consumed wastefully.

The invention solves the above-described problems, and an object thereof is to provide a glue application device and a glue application method for corrugated fiberboards, and a corrugated fiberboard manufacturing device that can reduce the amount of a glue solution transferred to trims.

Solution to Problem

In order to achieve the above described object, a glue application device for corrugated fiberboards according to an aspect of the invention, includes: a glue solution tank capable of storing a glue solution; a glue application roll capable of making the glue solution in the glue solution tank adhere to a surface thereof and transferring the glue solution to a glue application region of a corrugating medium of a corrugated fiberboard in a width direction; glue solution regulating members that regulate the adhesion of the glue solution outside the glue application region on the surface of the glue application roll; a regulating member movement mechanism that moves the glue solution regulating members in the width direction of the glue application region; and a control unit that sets a region, which is obtained by adding specified margins in the width direction outside of side edge locations with a cutting width dimension, to the glue application region, on the basis of the cutting width dimension with which the corrugated fiberboard is to be cut after passing through the glue application roll, and that controls the regulating member movement mechanism so as to dispose the glue solution regulating members at positions corresponding to the side edge locations of the glue application region.

According to the glue application device for corrugated fiberboards, since the region, which is obtained by adding specified margins outside of the side edge locations with the cutting width dimension in the width direction, is set to the glue application region, on the basis of the cutting width dimension with which the corrugated fiberboard is to be cut, and the glue solution regulating members are moved so as to regulate the adhesion of the glue solution outside the glue application region, the adhesion of the glue solution to the trims that become unnecessary side edges after the corrugated fiberboard is cut occurs in only the specified margins. For this reason, the amount of the glue solution transferred to the trims can be reduced. As a result, a situation where the glue solution is consumed wastefully can be prevented.

In this case, glue application device further includes side edge detection means for detecting side edge locations of a web before a corrugated fiberboard is formed. When the cutting of the corrugated fiberboard is not performed, the control unit controls the regulating member movement mechanism so as to dispose the glue solution regulating members at positions corresponding to side edge locations acquired from the side edge detection means.

According to the glue application device for corrugated fiberboards, when the cutting of the corrugated fiberboard is not performed, the width dimension between both the side edge locations of the web before the corrugated fiberboard is formed is set to the glue application region. Since the glue solution regulating members are moved so as to regulate the adhesion of the glue solution outside the glue application region, glue application can be performed over the entire width dimension of the corrugated fiberboard.

In this case, glue application device further includes side edge detection means for detecting side edge locations of a web before a corrugated fiberboard is formed. When the side edge locations acquired from the side edge detection means are inside the side edge locations of the glue application region set on the basis of the cutting width dimension, the control unit controls the regulating member movement mechanism so as to dispose the glue solution regulating members at positions corresponding to the side edge locations acquired from the side edge detection means.

According to the glue application device for corrugated fiberboards, when the specified margins cannot be secured within the width dimensions to the trims that become unnecessary side edges after the corrugated fiberboard is cut, both the side edge locations of the web before the corrugated fiberboard is formed are set to the side edges of the glue application region. Since the glue solution regulating members are moved so as to regulate the adhesion of the glue solution outside the glue application region, glue application can be performed over the entire width dimension of the corrugated fiberboard after cutting.

In this case, glue application device further includes imaging means for imaging side edge regions of the corrugated fiberboard and side edge regions for a glue solution of the glue application roll at application positions; and image processing means for processing images captured by the imaging means and detecting the side edge locations of the corrugated fiberboard and the side edge locations for a glue solution of the glue application roll. The control unit controls the regulating member movement mechanism so as to move the glue solution regulating members to positions where the set glue application region is secured on the basis of the respective side edge locations acquired from the image processing means.

According to the glue application device for corrugated fiberboards, the positions of the glue solution regulating members can be appropriately determined on the basis of the side edge locations of the corrugated fiberboard and the side edge locations for a glue solution of the glue application roll that are obtained by imaging, and glue application to the glue application region can be performed reliably.

In this case, in the glue application device, the cutting width dimension is output from a production control device.

According to the glue application device for corrugated fiberboards, glue application to the glue application region can be reliably performed by appropriately determining the positions of the glue solution regulating members on the basis of the information from the production control device.

In this case, the glue application device for corrugated fiberboards further include after-cutting width dimension detection means for detecting an after-cutting width dimension after the corrugated fiberboard is cut. The control unit controls the regulating member movement mechanism, using the after-cutting width dimension acquired from the after-cutting width dimension detection means as the cutting width dimension.

According to the glue application device for corrugated fiberboards, glue application to the glue application region can be reliably performed by appropriately determining the positions of the glue solution regulating members on the basis of the information from the after-cutting width dimension detection means.

In order to achieve the above described object, a glue application method for corrugated fiberboards according to another aspect of the invention, includes: a step of setting the region, which is obtained by adding specified margins outside of side edge locations with a cutting width dimension in a width direction, to the glue application region, on the basis of the cutting width dimension with which a corrugated fiberboard is to be cut after glue application; a step of arranging glue solution regulating members, which regulate the adhesion of a glue solution outside the glue application region on the surface of a glue application roll that adheres the glue solution to the surface of a corrugating medium of the corrugated fiberboard by being rotated, at positions corresponding to side edge locations of the glue application region; and a step of transferring the glue solution adhering to the surface of the glue application roll onto the surface of the corrugating medium of the corrugated fiberboard.

According to the glue application method for corrugated fiberboards, since the region, which is obtained by adding the specified margins outside of the side edge locations with the cutting width dimension in the width direction, is set to the glue application region, on the basis of the cutting width dimension with which the corrugated fiberboard is to be cut, and the glue solution regulating members are moved so as to regulate the adhesion of the glue solution outside the glue application region, the adhesion of the glue solution to the trims that become unnecessary side edges after the corrugated fiberboard is cut occurs in only the specified margins. For this reason, the amount of the glue solution transferred to the trims can be reduced. As a result, a situation where the glue solution is consumed wastefully can be prevented.

In order to achieve the above described object, a glue application manufacturing device for corrugated fiberboards according to still another aspect of the invention, sticks a second liner onto the corrugating medium subjected to waveform processing to form a single-faced corrugated fiberboard, and subsequently sticks a first liner onto the corrugating medium in the single-faced corrugated fiberboard to form a double-faced corrugated fiberboard. The glue application device according to any one of above-described devices is applied such that the glue solution is made to adhere to apexes of a waveform of the corrugating medium.

According to the corrugated fiberboard manufacturing device, since the region, which is obtained by adding the specified margins outside of the side edge locations with the cutting width dimension in the width direction, is set to the glue application region, on the basis of the cutting width dimension with which the corrugated fiberboard is to be cut, and the glue solution regulating members are moved so as to regulate the adhesion of the glue solution outside the glue application region, the adhesion of the glue solution to the trims that become unnecessary side edges after the corrugated fiberboard is cut occurs in only the specified margins. For this reason, the amount of the glue solution transferred to the trims can be reduced. As a result, a situation where the glue solution is consumed wastefully can be prevented.

Advantageous Effects of Invention

According to the invention, the amount of the glue solution transferred to the trims can be reduced.

DESCRIPTION OF EMBODIMENTS

Preferred embodiments of the invention will be described below in detail with reference to the accompanying drawings. In addition, the invention is not limited by the embodiments and includes embodiments configured by combining respective embodiments when there are a plurality of embodiments.

Figure 1:
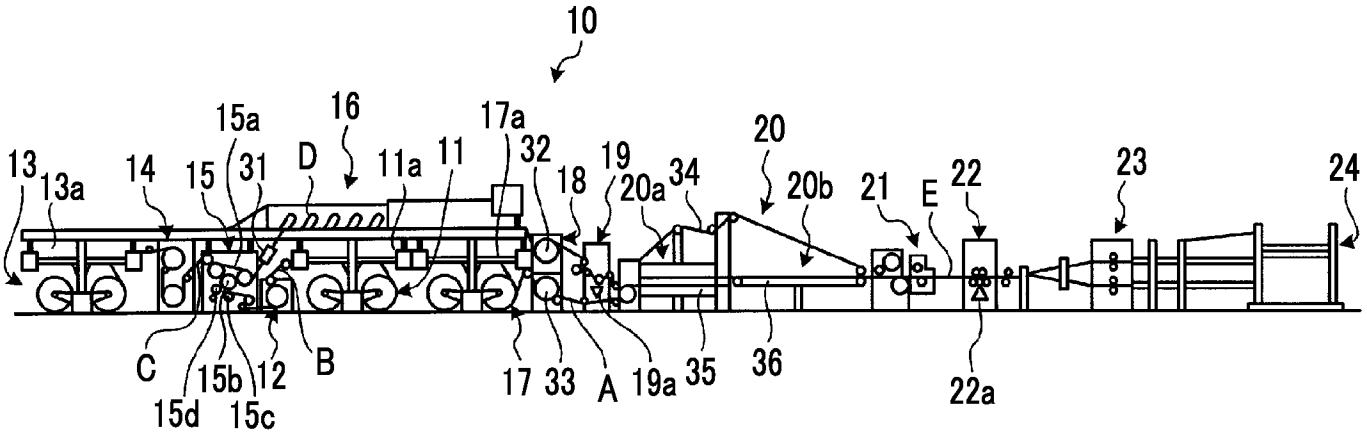
FIG. 1 is a schematic view illustrating a corrugating machine as a corrugated fiberboard manufacturing device related to an embodiment of the invention.

FIG. 1 is a schematic view illustrating a corrugating machine as a corrugated fiberboard manufacturing device related to an embodiment of the invention.

In the present embodiment, as illustrated in FIG. 1, a corrugating machine 10 as a corrugated fiberboard manufacturing device manufactures a single-faced corrugated fiberboard D by sticking a top linerboard C as a second liner, for example, as a web before forming a corrugated fiberboard onto a corrugating medium (core paper) B subjected to waveform processing as a web before forming the corrugated fiberboard, and manufactures a double-faced corrugated fiberboard E by sticking a bottom linerboard A as a first liner, for example, as a web before forming the corrugated fiberboard onto the corrugating medium B side in the manufactured single-faced corrugated fiberboard D.

The corrugating machine 10 has a mill roll stand 11 for the corrugating medium B, a preheater (preheating device) 12, a mill roll stand 13 for the top linerboard C, a preheater (preheating device) 14, a single facer 15, a bridge 16, a mill roll stand 17 for the bottom linerboard A, a preheater (preheating device) 18, a glue machine 19, a double facer 20, a rotary shear 21, a slitter scorer 22, a cutter 23, and a stacker 24.

The mill roll stand 11 is mounted with roll of paper around which core paper having the corrugating media B formed on both sides thereof, respectively, is wound in the shape of a roll, and a splicer (paper splicing device) 11*a* that performs paper splicing is provided above the mill roll stand. When paper is fed from one roll of paper, the other roll of paper is mounted on the splicer and preparation for paper splicing is made. If base paper of the one roll of paper runs out, this base paper of the one roller paper is spliced to base paper of the other roll of paper by the splicer 11*a*. While the base paper is supplied from the other roll of paper, the one roll of paper is mounted on the splicer and preparation for paper splicing is made. The base paper is sequentially spliced in this way, and is continuously delivered from the mill roll stand 11 toward the downstream side.

The mill roll stand 13 is mounted with roll of paper having the top linerboards C wound in the shape of a roll on both sides thereof, and a splicer 13*a* that performs paper splicing is provided above the mill roll stand. When paper is fed from one roll of paper, the other roll of paper is mounted on the splicer and preparation for paper splicing is made. If base paper of the one roll of paper runs out, this base paper of the one roller paper is spliced to base paper of the other roll of paper by the splicer 13*a*. While the base paper is supplied from the other roll of paper, the one roll of paper is mounted on the splicer and preparation for paper splicing is made. The base paper is sequentially spliced in this way, and is continuously delivered from the mill roll stand 13 toward the downstream side.

The respective preheaters 12 and 14 preheat the corrugating medium B and the top linerboard C, respectively. The respective preheaters 12 and 14 contain heating rolls therein to which steam is supplied, winds the base paper (the corrugating medium B and the top linerboard C) continuously delivered from the mill roll stands 11 and 13 around the heating rolls, and conveys the wound base paper, thereby raising the temperature of the base paper to a predetermined temperature.

The single facer 15 has a pressurization belt 15*a*, an upper stage roller 15*b*, and a lower stage roller 15*c*. The top linerboard C heated by the preheater 14 is transferred to a nip portion between the pressurization belt 15*a* and the upper stage roller 15*b*. Meanwhile, the corrugating medium B heated by the preheater 12 is subjected to waveform processing in an engagement portion between the upper stage roller 15*b* and the lower stage roller 15*c*, and then transferred to the nip portion between the pressurization belt 15*a* and the upper stage roller 15*b*. A glue application device 81 to be described below is disposed in the vicinity of the upper stage roller 15*b*. The corrugating medium B corrugated in the engagement portion between the upper stage roller 15*b* and the lower stage roller 15*c* is glued to respective apexes of the waveform by the glue application device 81, and is stuck on the top linerboard C in the nip portion between the pressurization belt 15*a* and the upper stage roller 15*b*, whereby the single-faced corrugated fiberboard D is formed.

A take-up conveyor 31 is provided obliquely upward on the downstream side in the conveying direction of the single facer 15. The take-up conveyor 31 is constituted of a pair of endless belts, and has a function of sandwiching this single-faced corrugated fiberboard D formed in the single facer 15, to convey the sheet to the bridge 16. The bridge 16 functions as a stay unit that primarily stays the single-faced corrugated fiberboard D in order to absorb a speed difference between the single facer 15 and the double facer 20.

The mill roll stand 17 is mounted with a roll of paper having the bottom linerboards A wound in the shape of a roll on both sides thereof, respectively, and a splicer 17*a* that performs paper splicing is provided above the mill roll stand. When paper is fed from one roll of paper, the other roll of paper is mounted on the splicer and preparation for paper splicing is made. If base paper of the one roll of paper runs out, this base paper of the one roll of paper is spliced to base paper of the other roll of paper by the splicer 17*a*. While the base paper is supplied from the other roll of paper, the one roll of paper is mounted on the splicer and preparation for paper splicing is made. The base paper is sequentially spliced in this way, and is continuously delivered from the mill roll stand 17 toward the downstream side.

The preheater 18 has a heating roll 32 for the single-faced corrugated fiberboard D (hereinafter referred to as single-faced corrugated sheet heating roll), and a heating roll 33 for the bottom linerboard A (hereinafter referred to as a bottom linerboard heating roll). The single-faced corrugated sheet heating roll 32 has a winding amount adjusting device, is heated to a predetermined temperature by steam being supplied to the inside thereof, and is able to preheat the single-faced corrugated fiberboard D by the top linerboard C side of the single-faced corrugated fiberboard D being wound around a peripheral surface thereof. Meanwhile, similarly, the bottom linerboard heating roll 33 also has a winding amount adjusting device, is heated to a predetermined temperature by steam being supplied to the inside thereof, and is able to preheat the bottom linerboard A by the bottom linerboard A being wound around a peripheral surface thereof.

The glue machine 19 has glue application devices 41 and 71 to be described below. The single-faced corrugated fiberboard D heated by the single-faced corrugated sheet heating roll 32 is guided into the glue machine 19 during transit, and when the sheet passes between a rider roll and a glue application roll, glue is applied to respective apexes of the corrugations of the corrugating medium B.

The single-faced corrugated fiberboard D to which glue is applied by the glue machine 19 is transferred to the double facer 20 in the following step. Additionally, the bottom linerboard A heated by the bottom linerboard heating roll 33 is transferred to the double facer 20 through the glue machine 19.

The double facer 20 is divided into an upstream heating section 20*a* and a downstream cooling section 20*b* along a line of travel of the single-faced corrugated fiberboard D and of the bottom linerboard A. The single-faced corrugated fiberboard D to which glue is applied by the glue machine 19 is carried in between the pressurization belt 34 and a hot plate 35 in the heating section 20*a*, and the bottom linerboard A is carried in between the pressurization belt 34 and the hot plate 35 so as to overlap the corrugating medium B side of the single-faced corrugated fiberboard D. Then, the single-faced corrugated fiberboard D and the bottom linerboard A are carried in between the pressurization belt 34 and the hot plate 35, and then are integrated in a vertically overlapping state and transferred toward the cooling section 20*b*. During this transfer, the single-faced corrugated fiberboard D and the bottom linerboard A are heated while being pressurized, and are thereby stuck to each other thereby forming the double-faced corrugated fiberboard E. The double-faced corrugated fiberboard E is naturally cooled in the cooling section 20*b* when being conveyed while being pinched by the pressurization belt 34 and the conveying belt 36.

The double-faced corrugated fiberboard E manufactured by the double facer 20 is transferred to the rotary shear 21. The rotary shear 21 cuts the double-faced corrugated fiberboard E over the full width or partially in a width direction.

The slitter scorer 22 cuts the double-faced corrugated fiberboard E so as to have a predetermined cutting width dimension Wc (refer to FIG. 5) in a conveying direction, and forms ruled lines that extend in the conveying direction. The slitter scorer 22 has a plurality of sets consisting of an upper ruled line roll and a lower ruled line roll that are disposed to face each other with the double-faced corrugated fiberboard E therebetween, in the width direction, and has a plurality of sets of slitter knives, which are disposed below the double-faced corrugated fiberboard E, in the width direction. The cutting width dimension Wc of the double-faced corrugated fiberboard E is input to a production control device 100 (refer to FIG. 3) that generally manages the corrugating machine 10 by an operator.

The cutter 23 cuts the double-faced corrugated fiberboard E, which is cut in the conveying direction by the slitter scorer 22, in the width direction, and forms the sheet in the shape of a plate. The cutter 23 receives and processes two double-faced corrugated fiberboards E, which are cut with a predetermined width along the conveying direction in the slitter scorer 22, in two upper and lower stages, and both the sheets have substantially the same configuration. The stacker 24 stacks the double-faced corrugated fiberboards E cut by cutter 23, and discharges the sheets to the outside of the device as products.

Embodiment 1

Hereinafter, a glue application device for corrugated fiberboards related to the present embodiment will be described. Here, the glue application device 41 provided in the above-described glue machine 19 will be described. The glue application device 41 supplies a glue solution to respective apexes of the waveform of the corrugating medium B in the single-faced corrugated fiberboard D.

Figure 2:
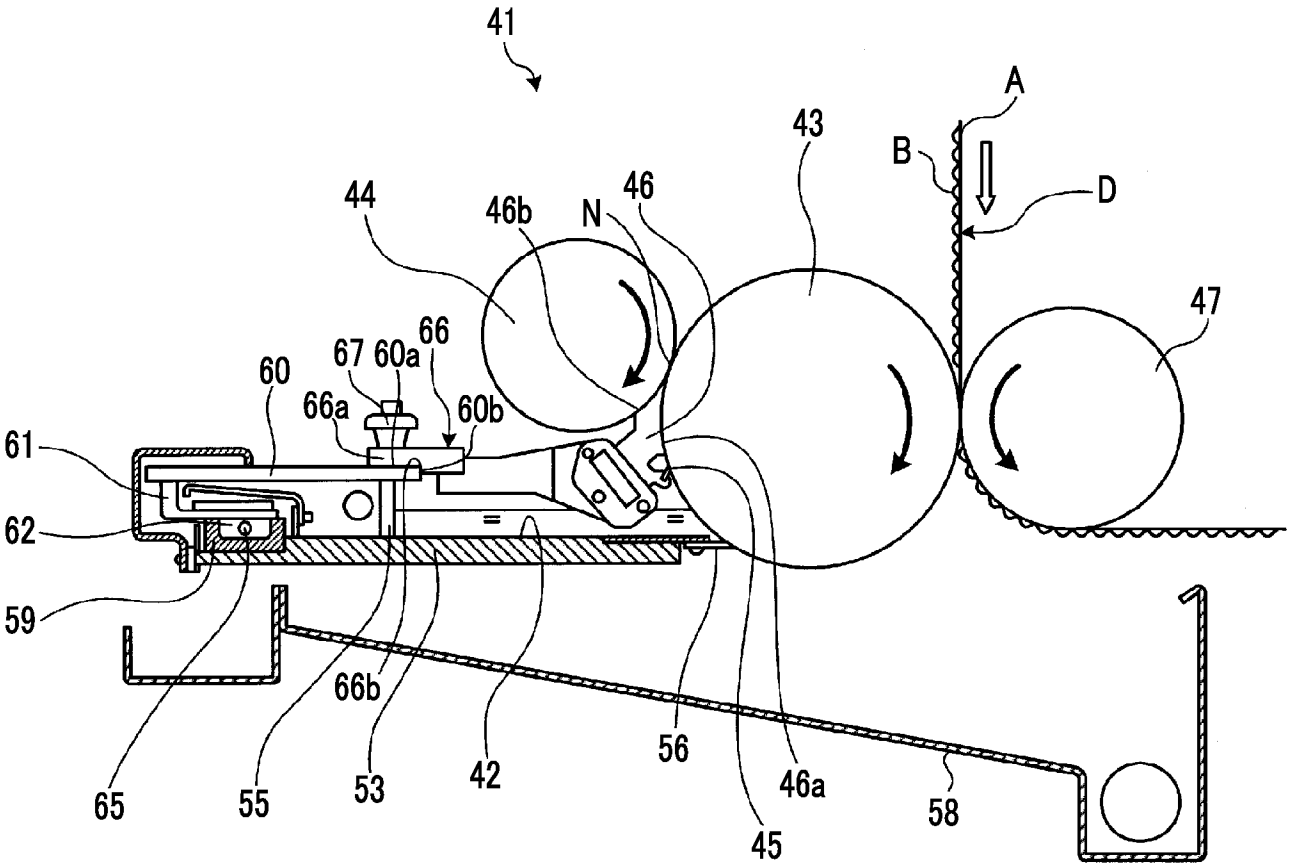
FIG. 2 is a side view illustrating a glue application device for corrugated fiberboards related to Embodiment 1 of the invention.
Figure 3:
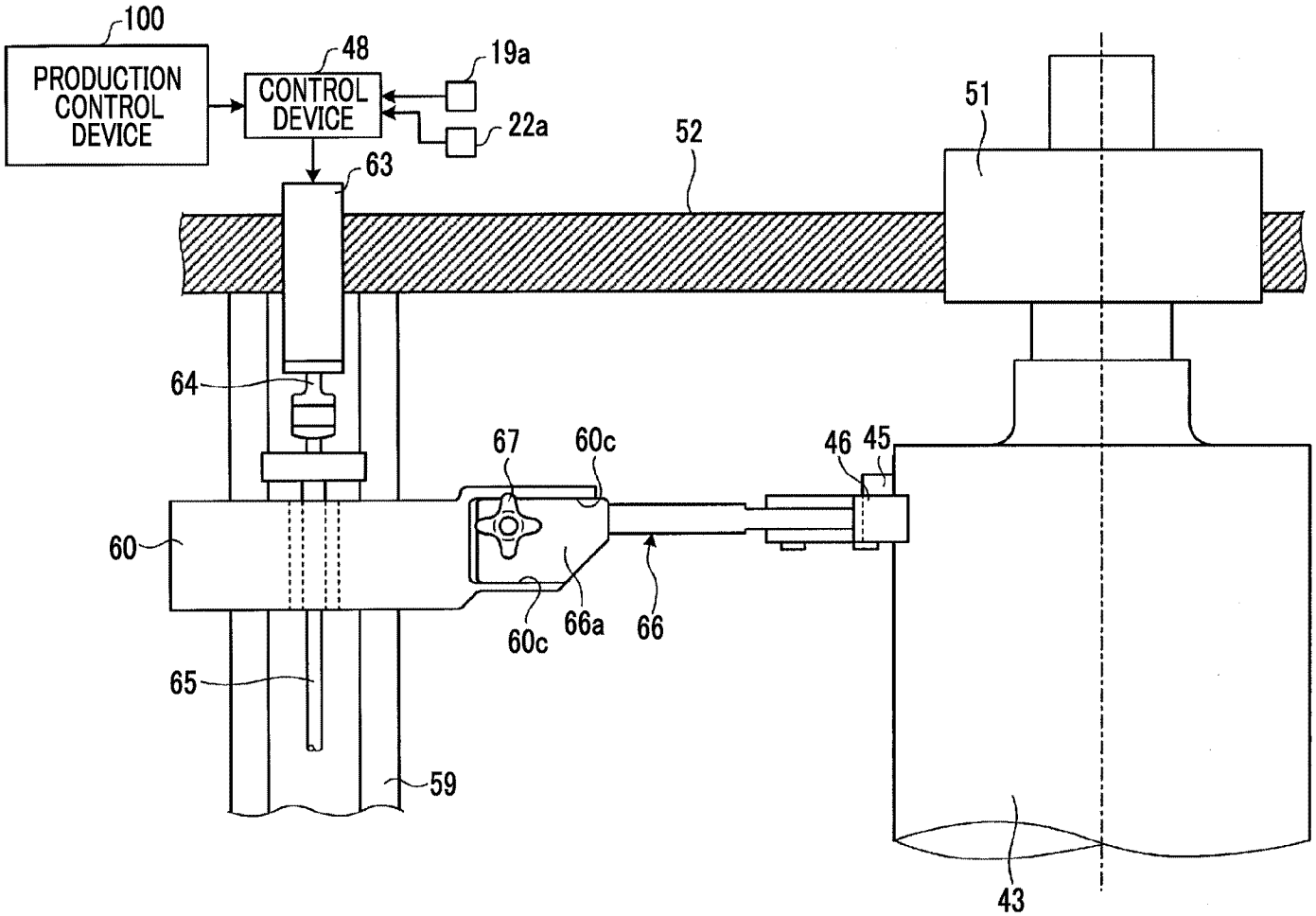
FIG. 3 is a plan view illustrating a portion of the glue application device for corrugated fiberboards related to Embodiment 1 of the invention.
Figure 4:
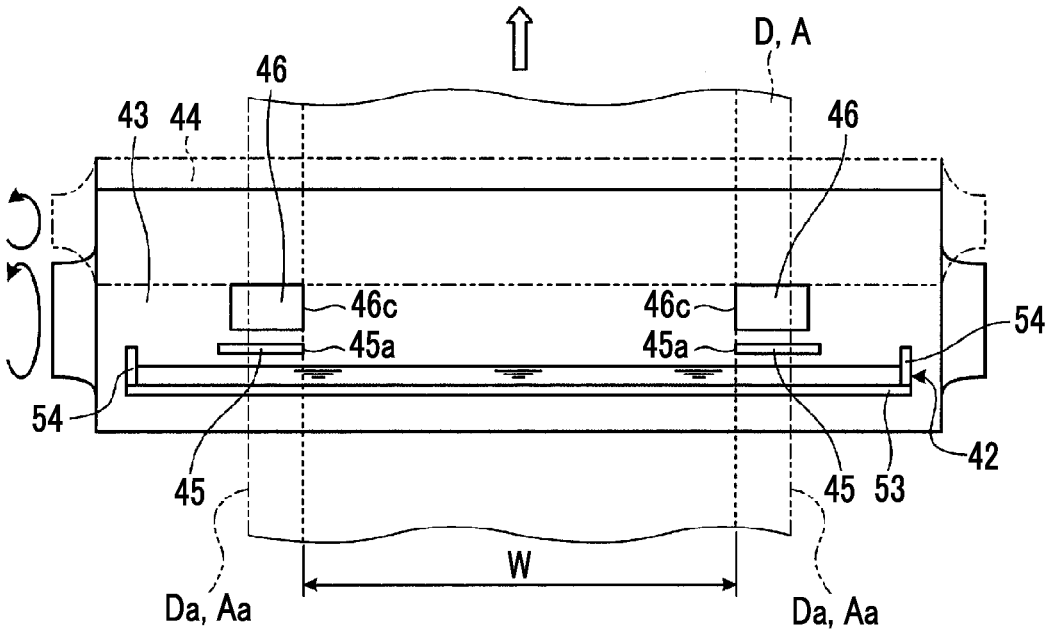
FIG. 4 is a schematic view illustrating the arrangement of scraping members and damming members with respect to a glue application roll.

FIG. 2 is a side view illustrating the glue application device for corrugated fiberboards related to the present embodiment, FIG. 3 is a plan view illustrating a portion of the glue application device for corrugated fiberboards related to the present embodiment, and FIG. 4 is a schematic view illustrating the arrangement of scraping members and damming members with respect to the glue application roll.

The glue application device 41 has a glue solution tank 42, a glue application roll 43, a doctor roll 44, a scraping member (glue solution regulating member) 45, a damming member 46, and a rider roll 47.

The glue application roll 43 is a roll that forms a columnar shape, and as illustrated in FIG. 3, has respective edges in the axial direction rotatably supported on a device frame 52 by bearings 51. The doctor roll 44 is a roll that forms a columnar shape, and has respective edges in the axial direction rotatably supported on the device frame 52 by bearings (not illustrated), and a nip portion having a predetermined gap is secured between the doctor roll and the glue application roll 43. The rider roll 47 has respective edges in the axial direction rotatably supported on the device frame 52 by bearings (not illustrated), and the single-faced corrugated fiberboard D is conveyed between the rider roll and the glue application roll 43. In addition, the doctor roll 44 and the rider roll 47 are supported so as to be capable of being brought closer to and separated from the glue application roll 43, and the amounts of nip in the respective nip portions between the doctor roll and the rider roll, and the glue application roll 43 can be adjusted.

The glue application roll 43 is rotatably driven in the clockwise direction in FIG. 2 by a drive device (not illustrated), the doctor roll 44 is rotatably driven in the clockwise direction in FIG. 2, and the rider roll 47 is rotatable in the counterclockwise direction in FIG. 2. In this case, the glue application roll 43 is rotationally driven in synchronization with the conveying speed of the single-faced corrugated fiberboard D, and the rider roll rotates together with the single-faced corrugated fiberboard D as the single-faced corrugated fiberboard D is wound over a predetermined angle range.

In addition, the glue application roll 43 is a metal roll of which the surface is formed in a concavo-convex shape and is subjected to chrome plating such that a glue solution adheres easily thereto. Additionally, the doctor roll 44 and the rider roll 47 are metal rolls of which the surfaces are made flat and are subjected to chrome plating. In this case, the respective rolls 43, 44, and 47 may be made of stainless steel.

The glue solution tank 42 opens upward, enables a glue solution to be stored therein, and a portion of the glue application roll 43 is able to come into contact with the glue solution and adhere the glue solution to the surface thereof. The glue solution tank 42, as illustrated in FIGS. 2 and 4, has a bottom plate 53 and a pair of side plates 54 that are illustrated in FIG. 4 and a regulating plate 55 illustrated in FIG. 2, and the glue application roll 43 is disposed on one end side of the bottom plate 53.

The bottom plate 53 is set to have a width narrower than the glue application roll 43, and has a seal plate 56 fixed to one end thereof. The seal plate 56 is disposed at a predetermined interval from the surface of the glue application roll 43. Additionally, the bottom plate 53 has the side plates 54 fixed to both side portions thereof. A seal member (not illustrated), which is pressed against the surface of the glue application roll 43 due to an elastic force, is mounted on one end of each side plate 54. Therefore, a glue solution adhesion region for the glue application roll 43 is set by the bottom plate 53 and each side plate 54. The regulating plate 55 is fixed to other end sides in the bottom plate 53 and the side plate 54, and is set to be lower than the bottom plate 53 and the side plate 54. If the amount of the glue solution increases, the glue solution can overflow the regulating plate 55, and a uniform amount of glue solution can be maintained in the glue solution tank 42.

Additionally, as illustrated in FIG. 2, a storage pan 58 is disposed below the glue solution tank 42. In the glue solution tank 42, the seal plate 56 of the bottom plate 53 is disposed at a predetermined interval from the surface of the glue application roll 43, and the seal member of the side plate 54 is pressed against the surface of the glue application roll 43. Therefore, during the rotation of the glue application roll 43, there is no case where the glue solution of the glue solution tank 42 leaks from the predetermined gap between the seal plate 56 and the glue application roll 43 due to the rotary power of the glue application roll 43. Meanwhile, during the stoppage of the glue application roll 43, the glue solution of the glue solution tank 42 leaks from the predetermined gap between the seal plate 56 and the glue application roll 43 and is stored in the storage pan 58.

As illustrated in FIGS. 2 and 3, although the rotational axes of the glue application roll 43 and the doctor roll 44 are disposed parallel to each other, the rotational directions of the glue application roll and the doctor roll are opposite directions in the nip portion, and the predetermined gap is secured in the nip portion between both the glue application roll and the doctor roll. Therefore, the doctor roll 44 can scrape off the glue solution adhering to the glue application roll 43 to adjust the glue solution to a preset film thickness. Additionally, the rotational axes of the glue application roll 43 and the rider roll 47 are disposed parallel to each other, and the rotational directions of the glue application roll and the rider roll are the same direction in the nip portion. Thus, the single-faced corrugated fiberboard D passing through between these rolls can be conveyed in the direction of an arrow, and the glue solution can be applied to the apexes of the corrugations of the single-faced corrugated fiberboard D.

In this case, since the doctor roll 44 scrapes off the glue solution adhering to the glue application roll 43 and adjusts the glue solution to a set film thickness, the glue application roll 43 can apply the glue solution in an amount according to the adjusted predetermined film thickness to the apexes of the corrugations of the single-faced corrugated fiberboard D.

The scraping member 45 presses and contacts the surface of the glue application roll 43 located closer to the upstream side in the rotational direction than the nip portion between the glue application roll and the doctor roll 44, and regulates the adhesion of the glue solution outside of the glue application region of the corrugating medium B in the single-faced corrugated fiberboard D. The scraping member 45 forms a flat plate shape, and has a predetermined width in the axial direction in the glue application roll 43. The scraping member 45 is formed from resin (or plastic or elastomer), such as urethane, and is thereby elastically deformable, and a tip portion thereof is pressed against the surface of the glue application roll 43 in a state where the scraping member is fixed to the damming member 46 to be described below. In this case, the scraping member 45 comes into contact with the surface of the glue application roll 43 with an angle of approach defined with respect to a tangential line of the glue application roll 43, and can substantially scrape off a glue film adhering to the glue application roll 43. In addition, it is preferable that this angle of approach is 30° or more and 60° or less, and the glue film of the glue application roll 43 can be appropriately removed by setting the angle of approach to within this range.

The damming member 46 comes into contact with the surface of the glue application roll 43 located closer to the upstream side in the rotational direction than the nip portion between the glue application roll and the doctor roll 44 and the downstream side in the rotational direction than the contact position of the scraping member 45, and dams the glue solution protruding from the glue application region of the corrugating medium B in the single-faced corrugated fiberboard D. The damming member forms a block shape, and is provided with a first bending contact surface 46*a* that has a predetermined width in the axial direction in the glue application roll 43 on a tip portion side thereof, has a predetermined length in the circumferential direction in the glue application roll 43, and comes into surface contact with the surface of the glue application roll 43. The first bending contact surface 46*a* is set to have substantially the same curvature radius as the surface of the glue application roll 43, and is provided to extend to the nip portion N between the glue application roll 43 and the doctor roll 44. Additionally, the damming member 46 is provided with a second bending contact surface 46*b* that has a predetermined width in the axial direction in the doctor roll 44 on the tip portion side thereof, has a predetermined length in the circumferential direction in the doctor roll 44, and comes into surface contact with the surface of the doctor roll 44. The second bending contact surface 46*b* is set to have substantially the same curvature radius as the surface of the doctor roll 44, and is provided to extend to the nip portion N between the glue application roll 43 and the doctor roll 44. The first bending contact surface 46*a* and the second bending contact surface 46*b* have the same width. The damming member 46 is formed from, for example, MC nylon (trade name of Polypenco Japan Ltd.) as polyamide synthetic fibers. In addition, the damming member 46 may be formed from resin (plastic, elastomer, or urethane), such a high-molecular weight compound, without being limited to this MC nylon. In this case, the damming member 46 does not need to be formed from resin in its entirety, and a resin layer (fluororesin layer or the like) may be provided on a contact surface (the first bending contact surface 46*a* or the second bending contact surface 46*b*) that comes into contact with the glue application roll 43 or the doctor roll 44. That is, wear of the surface in the glue application roll 43 or the doctor roll 44 is prevented by providing the damming member 46 made of resin with respect to the glue application roll 43 or the doctor roll 44 that is made of metal. Additionally, the damming member 46 is supported via a biasing member (for example, a compression coil spring) with respect to a supporting arm 66 in a regulating member movement mechanism that is not clearly illustrated in the drawing but is described below, and is biased in a direction in which the first bending contact surface 46*a* and the second bending contact surface 46*b* are pressed against the surfaces of the glue application roll 43 and the doctor roll 44 due to the biasing force of the biasing member.

The regulating member movement mechanism moves the scraping member 45 as a glue solution regulating member in the axial direction of the glue application roll 43 and in the width direction of a glue application region W to be described below. In this regulating member movement mechanism, as illustrated in FIG. 3, an end of a guide rail 59 parallel to the respective rolls 43, 44, and 47 is fixed to the device frame 52. A movable plate 60 is disposed along a direction orthogonal to the guide rail 59 above the guide rail 59. The movable plate 60 has a slide 62 fixed to a base end thereof via a bracket 61, and the slide 62 is supported so as to be movable along the guide rail 59. Additionally, a drive motor 63 is fixed to the device frame 52. The drive motor 63 has a screw shaft 65 coupled to a driving shaft 64 thereof. The screw shaft 65 is screwed to the slide 62. Therefore, if the drive motor is driven, the screw shaft 65 can rotate via the driving shaft 64, and the movable plate 60 can move along the guide rail 59 via the slide 62 to which the screw shaft is screwed.

The movable plate 60 has the supporting arm 66 provided at a tip portion thereof. The supporting arm 66 is provided to extend from the movable plate 60 to the glue application roll 43 side, has a base end fixed to the movable plate 60 with a fastening bolt 67, and has the scraping member 45 as the glue solution regulating member and the damming member 46 attached to a tip portion thereof. The supporting arm 66 is able to be positioned by three support surfaces running along directions that intersect the movable plate 60. As illustrated in FIGS. 2 and 3, the supporting arm 66 is positioned in the vertical direction as a lower surface of an attachment portion 66*a* on the base end side is placed on a placement surface 60*a* formed at the tip portion of the movable plate 60. Additionally, the supporting arm 66 is positioned in the longitudinal direction (in approaching and separating directions with respect to the glue application roll 43) as a stepped portion 66*b* on the base end side abuts against an end surface 60*b* formed at the tip portion of the movable plate 60. Moreover, the supporting arm 66 is positioned in the width direction (in the axial direction of the glue application roll 43) as both side surfaces of the attachment portion 66*a* on the base end side abut against a vertical wall surface 60*c* formed at the tip portion of the movable plate 60.

Since the scraping member 45 and the damming member 46 are supported by the same supporting arm 66, the positioning thereof with respect to the glue application roll 43 can be performed easily, and the scraping member and the damming member can be integrally moved in the axial direction of the glue application roll 43 and can be positionally adjusted easily. That is, the scraping member 45 and the damming member 46 need to adjust their positions in accordance with the width of the bottom linerboard A stuck on the single-faced corrugated fiberboard D, and this adjustment work can be performed easily.

That is, as illustrated in FIG. 4, when the single-faced corrugated fiberboard D is conveyed with respect to the glue application roll 43, the glue application region W of the single-faced corrugated fiberboard D is adjusted in accordance with the width of the bottom linerboard A stuck on the single-faced corrugated fiberboard D by the double facer 20 on the downstream side. Specifically, the glue application region W of the single-faced corrugated fiberboard D is adjusted so as to become narrower than the width of the bottom linerboard A. In addition, the width of the single-faced corrugated fiberboard D and the width of the bottom linerboard A are set to be the same. Therefore, the damming members 46 are respectively disposed in regions in the vicinity of both side edges of the single-faced corrugated fiberboard D and the bottom linerboard A under conveyance. Additionally, the scraping members 45 are also respectively disposed in regions in the vicinity of both side edges of the single-faced corrugated fiberboard D and the bottom linerboard A under conveyance.

In the present embodiment, inner end surfaces 46*c* in the width direction (the axial direction of the glue application roll 43) of the respective damming members 46 are set at positions that fall within predetermined width dimensions from respective edges Da and Aa of the single-faced corrugated fiberboard D and the bottom linerboard A, and inner end surfaces 45*a* of the scraping members 45 in the width direction (the axial direction of the glue application roll 43) are set at positions that fall within the predetermined width dimensions from the respective edges Da and Aa of the single-faced corrugated fiberboard D and the bottom linerboard A. However, the scraping members 45 may be disposed such that the positions of the inner end surfaces 45*a* are further inside with respect to the positions of the inner end surfaces 46*c* of the damming members 46.

Figure 5:
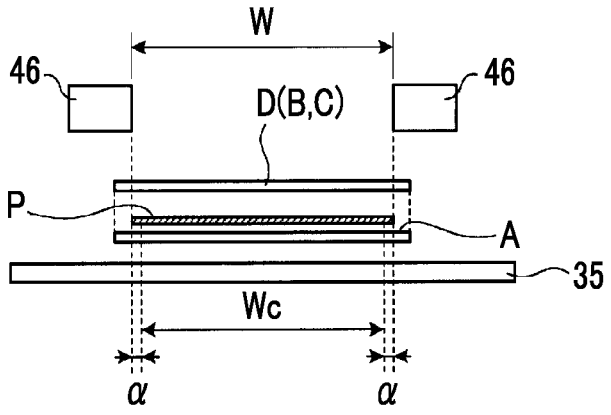
FIG. 5 is a schematic view for explaining a glue application region.

Here, the glue application region W of the single-faced corrugated fiberboard D will be described in detail with reference to a schematic view for explaining the glue application region of FIG. 5. As described above, the corrugating machine 10 manufactures the single-faced corrugated fiberboard D by sticking the top linerboard C subjected to waveform processing onto the corrugating medium B, and manufactures the double-faced corrugated fiberboard E by sticking the bottom linerboard A onto the single-faced corrugated fiberboard D. In this case, generally, the single-faced corrugated fiberboard D (the corrugating medium B and the top linerboard C) and the bottom linerboard A are set to have the same width dimension. The width dimension of the glue application region W where the glue application roll 43 applies glue on the single-faced corrugated fiberboard D, with respect to the single-faced corrugated fiberboard D and the bottom linerboard A that are set in this way, that is, the width dimension of the glue solution, which is scraped off by both the scraping members 45 and left behind on the glue application roll 43, is set to be narrower than the width of the bottom linerboard A. The glue application region W in the present embodiment has a width dimension that is wider by specified margins α to both side edge sides than the cutting width dimension We of the double-faced corrugated fiberboard E cut by the above-described slitter scorers 22. The specified margin α is input to a control device (control unit) 48 to be described below in advance, is, for example, about 10 mm, and is normally set to be within a range inside the side edge of the single-faced corrugated fiberboard D (the corrugating medium B and the top linerboard C) and the bottom linerboard A in the width direction. That is, the specified margin α is an area where glue is applied to a trim that is an unnecessary side edge cut by the slitter scorer 22, and are areas where the glue solution does not protrude outside in the width direction from the side edge of the single-faced corrugated fiberboard D and the bottom linerboard A.

When the bottom linerboard A is stuck on the single-faced corrugated fiberboard D and is conveyed on the hot plate 35 of the heating section 20*a* in this state, the glue solution P is dried. In this case, if the glue solution P is applied outside of the glue application region W, the glue solution P protrudes from the edge of the bottom linerboard A in the width direction, the glue solution P adheres to the hot plate 35 and is cured. In the present embodiment, since the width dimension (the glue application region W of the single-faced corrugated fiberboard D) of the glue solution P on the glue application roll 43 is set as described above by both the scraping members 45, the protrusion of the glue solution P from the side edges of the single-faced corrugated fiberboard D and the bottom linerboard A is prevented.

The regulating member movement mechanism that moves the scraping members 45 is controlled by the control device (control unit) 48 illustrated in FIG. 3. In the corrugating machine 10, as described above, the cutting width dimension Wc of the double-faced corrugated fiberboard E is input to the production control device 100. The control device 48 acquires the cutting width dimension Wc, and sets a region, which is obtained by adding the specified margins α outside of the side edge locations with the cutting width dimension Wc in the width direction on the basis of the cutting width dimension Wc, to the glue application region W. Then, the control device 48 controls the regulating member movement mechanism so as to dispose the scraping members 45 as the glue solution regulating members at positions corresponding to the side edge locations of the glue application region W. Specifically, the control device 48 drives the drive motor 63 and moves the movable plate 60 in accordance with the set glue application region W, thereby moving the scraping members 45 to predetermined positions via the supporting arm 66. The predetermined positions are positions that coincide with edges of the glue application region W (a width dimension that is wider by the specified margins α toward both the side edge sides than the cutting width dimension Wc of the double-faced corrugated fiberboard E cut by the slitter scorers 22).

Namely, the glue application device 41 for corrugated fiberboards in the present embodiment includes the glue solution tank 42 capable of storing glue solution; the glue application roll 43 capable of making the glue solution in the glue solution tank 42 adhere to a surface thereof and transferring the glue solution to the glue application region W in the width direction of the corrugating medium B of the single-faced corrugated fiberboard D; the scraping members 45 that regulate the adhesion of the glue solution outside the glue application region W on the surface of the glue application roll 43; the regulating member movement mechanism that moves the scraping members 45 in the width direction of the glue application region W; and the control device 48 that sets the region, which is obtained by adding the specified margins α outside of the side edge locations with the cutting width dimension Wc in the width direction, to the glue application region W, on the basis of the cutting width dimension Wc with which the double-faced corrugated fiberboard E is to be cut after passing through the glue application roll 43 and that controls the regulating member movement mechanism so as to dispose the scraping members 45 at the positions corresponding to the side edge locations of the glue application region W.

Additionally, the glue application method for corrugated fiberboards in the present embodiment includes a step of setting the region, which is obtained by adding the specified margins α outside of the side edge locations with the cutting width dimension Wc in the width direction, to the glue application region W, on the basis of the cutting width dimension Wc with which the double-faced corrugated fiberboard E is to be cut after glue application; a step of arranging the scraping members 45, which regulate the adhesion of the glue solution outside the glue application region W on the surface of the glue application roll 43 that adheres the glue solution to the surface of the corrugating medium B of the single-faced corrugated fiberboard D by being rotated, at the positions corresponding to the side edge locations of the glue application region W; and a step of transferring the glue solution adhering to the surface of the glue application roll 43 onto the surface of the corrugating medium B of the single-faced corrugated fiberboard D.

According to the glue application device 41 and the glue application method for corrugated fiberboards, since the region, which is obtained by adding the specified margins α outside of the side edge locations with the cutting width dimension Wc in the width direction, is set to the glue application region W, on the basis of the cutting width dimension Wc with which the double-faced corrugated fiberboard E is to be cut, and the scraping members 45 are moved so as to regulate the adhesion of the glue solution outside the glue application region W, the adhesion of the glue solution to the trims that become unnecessary side edges after the double-faced corrugated fiberboard E is cut occurs in only the specified margins α. For this reason, the amount of the glue solution transferred to the trims can be reduced. As a result, a situation where the glue solution is consumed wastefully can be prevented.

Moreover, according to the glue application device 41 for corrugated fiberboards, when the double-faced corrugated fiberboard E is cut with the cutting width dimension Wc, the portions of the glued specified margins α are cut. For this reason, cutting can be precisely performed by cutting portions with a strong waist by means of glue application.

Meanwhile, as illustrated in FIGS. 1 and 3, the glue machine 19 is provided with a side edge detection sensor (side edge detection means) 19*a* that detects the side edge locations of the bottom linerboard A (the web before the double-faced corrugated fiberboard E is formed) conveyed before being stuck on the single-faced corrugated fiberboard D. The side edge detection sensor 19*a* outputs the detected side edge locations of the bottom linerboard A to the control device 48. Then, the control device 48 acquires the side edge locations of the bottom linerboard A, thereby controlling the regulating member movement mechanism as follows.

In the above-described embodiment, although the corrugating machine 10 cuts the double-faced corrugated fiberboard E to the cutting width dimension Wc, this cutting may not be performed. In such a case, in the glue application device 41 for corrugated fiberboards, the control device 48 controls the regulating member movement mechanism so as to dispose the scraping members 45 at the positions corresponding to the side edge locations of the bottom linerboard A acquired from the side edge detection sensor 19*a*. Specifically, the control device 48 drives the drive motor 63 and moves the movable plate 60 in accordance with the acquired side edge locations of the bottom linerboard A, thereby moving the scraping members 45 to predetermined positions via the supporting arm 66. These predetermined positions are positions that coincide with the side edge locations of the bottom linerboard A.

Namely, the glue application device 41 for corrugated fiberboards in the present embodiment further includes the side edge detection sensor 19*a* that detects the side edge locations of the bottom linerboard A before being stuck, and when the cutting of the double-faced corrugated fiberboard E is not performed, the control device 48 controls the regulating member movement mechanism so as to dispose the scraping members 45 at the positions corresponding to the side edge locations acquired from the side edge detection sensor 19*a*.

According to the glue application device 41 for corrugated fiberboards, when the cutting of the double-faced corrugated fiberboard E is not performed, the width dimension between both the side edge locations of the bottom linerboard A before being stuck is set to the glue application region W. Since the scraping members 45 are moved so as to regulate the adhesion of the glue solution outside the glue application region W, glue application can be performed over the entire width dimension of the double-faced corrugated fiberboard E.

In addition, in the present embodiment, when the cutting of the double-faced corrugated fiberboard E is not performed, the control device 48 controls the regulating member movement mechanism so as to dispose the scraping members 45 at the positions corresponding to the side edge locations of the bottom linerboard A acquired from the side edge detection sensor 19*a*. However, when there is a change in order, the regulating member movement mechanism may be moved on the basis of the width dimension of the bottom linerboard A input to the production control device 100.

Additionally, in the above-described embodiment, the corrugating machine 10 cuts the double-faced corrugated fiberboard E to the cutting width dimension Wc, removes the trims that become unnecessary side edges, and sets the specified margins α within the width dimensions of the trims. However, the specified margins α may exceed the width dimensions of the trims. That is, the region, which is obtained by adding the specified margins α outside of the side edge locations with the cutting width dimension Wc in the width direction, may be set to the glue application region W, and the side edge locations of the bottom linerboard A acquired from the side edge detection sensor 19*a* may be present inside the side edge locations of the glue application region W. Additionally, when the bottom linerboard A meanders in the width direction and is conveyed in a biased manner, the specified margins α may exceed the width dimensions of the trims. In such a case, in the glue application device 41 for corrugated fiberboards, the control device 48 controls the regulating member movement mechanism so as to dispose the scraping members 45 at the positions corresponding to the side edge locations acquired from the side edge detection sensor 19*a*.

Namely, the glue application device 41 for corrugated fiberboards in the present embodiment further includes the side edge detection sensor 19*a* that detects the side edge locations of the bottom linerboard A (the web before the double-faced corrugated fiberboard E is formed) before being stuck, and the control device 48 controls the regulating member movement mechanism so as to dispose the scraping members 45 at the positions corresponding to the side edge locations acquired from the side edge detection sensor 19*a* when the side edge locations acquired from the side edge detection sensor 19*a* are present inside the side edge locations of the glue application region W set on the basis of the cutting width dimension Wc.

According to the glue application device 41 for corrugated fiberboards, when the specified margins α cannot be secured within the width dimensions to the trims that become unnecessary side edges after the double-faced corrugated fiberboard E is cut, both the side edge locations of the bottom linerboard A before being stuck are set to the side edges of the glue application region W. Since the scraping members 45 are moved so as to regulate the adhesion of the glue solution outside the glue application region W, glue application can be performed over the entire width dimension of the double-faced corrugated fiberboard E after cutting.

In addition, when the side edge locations acquired from the side edge detection sensor 19*a* are present inside the side edge locations of the glue application region W set on the basis of the cutting width dimension Wc, the control device 48 controls the regulating member movement mechanism so as to dispose the scraping members 45 at the positions corresponding to the side edge locations acquired from the side edge detection sensor 19*a*. However, when there is a change in order, the regulating member movement mechanism may be moved on the basis of the width dimension of the bottom linerboard A input to the production control device 100.

In addition, when the side edge locations acquired from the side edge detection sensor 19*a* are present inside the side edge locations of the glue application region W set on the basis of the cutting width dimension Wc, and the specified margins α cannot be secured within the width dimensions of the trims that become unnecessary side edges after the double-faced corrugated fiberboard E is cut, and when the specified margins α can be reduced within the width dimensions of the trims, the control device 48 may reset the glue application region W obtained by subtracting the specified margins α so as to be present within the acquired side edge locations of the bottom linerboard A, and may control the regulating member movement mechanism so as to dispose the scraping members 45 as the glue solution regulating members at the positions corresponding to the side edge locations with the glue application region W. Even in this way, glue application can be performed over the entire width dimension of the double-faced corrugated fiberboard E after cutting.

Additionally, in the glue application device 41 for corrugated fiberboards in the present embodiment, it is preferable that the cutting width dimension We is output from the production control device 100.

According to the glue application device 41 for corrugated fiberboards, glue application to the glue application region W can be reliably performed by appropriately determining the positions of the scraping members 45 on the basis of the information from the production control device 100.

Meanwhile, as illustrated in FIGS. 1 and 3, the glue machine 19 is provided with an after-cutting width dimension detection sensor (after-cutting width dimension detection means) 22*a* that detects an after-cutting width dimension with which the double-faced corrugated fiberboard E is to be cut. The after-cutting width dimension detection sensor 22*a* outputs the detected after-cutting width dimension to the control device 48. The control device 48 acquires the after-cutting width dimension, thereby using the after-cutting width dimension as the cutting width dimension Wc. Specifically, the control device 48 uses the after-cutting width dimension acquired from the after-cutting width dimension detection sensor 22*a* as the cutting width dimension Wc, and sets the region, which is obtained by adding the specified margins α outside of the side edge locations with the cutting width dimension Wc in the width direction on the basis of the cutting width dimension Wc, to the glue application region W. Then, the control device 48 controls the regulating member movement mechanism so as to dispose the scraping members 45 as the glue solution regulating members at the positions corresponding to the side edge locations of the glue application region W.

According to the glue application device 41 for corrugated fiberboards, glue application to the glue application region W can be reliably performed by appropriately determining the positions of the scraping members 45 on the basis of the information from the after-cutting width dimension detection sensor 22*a*.

Figure 6:
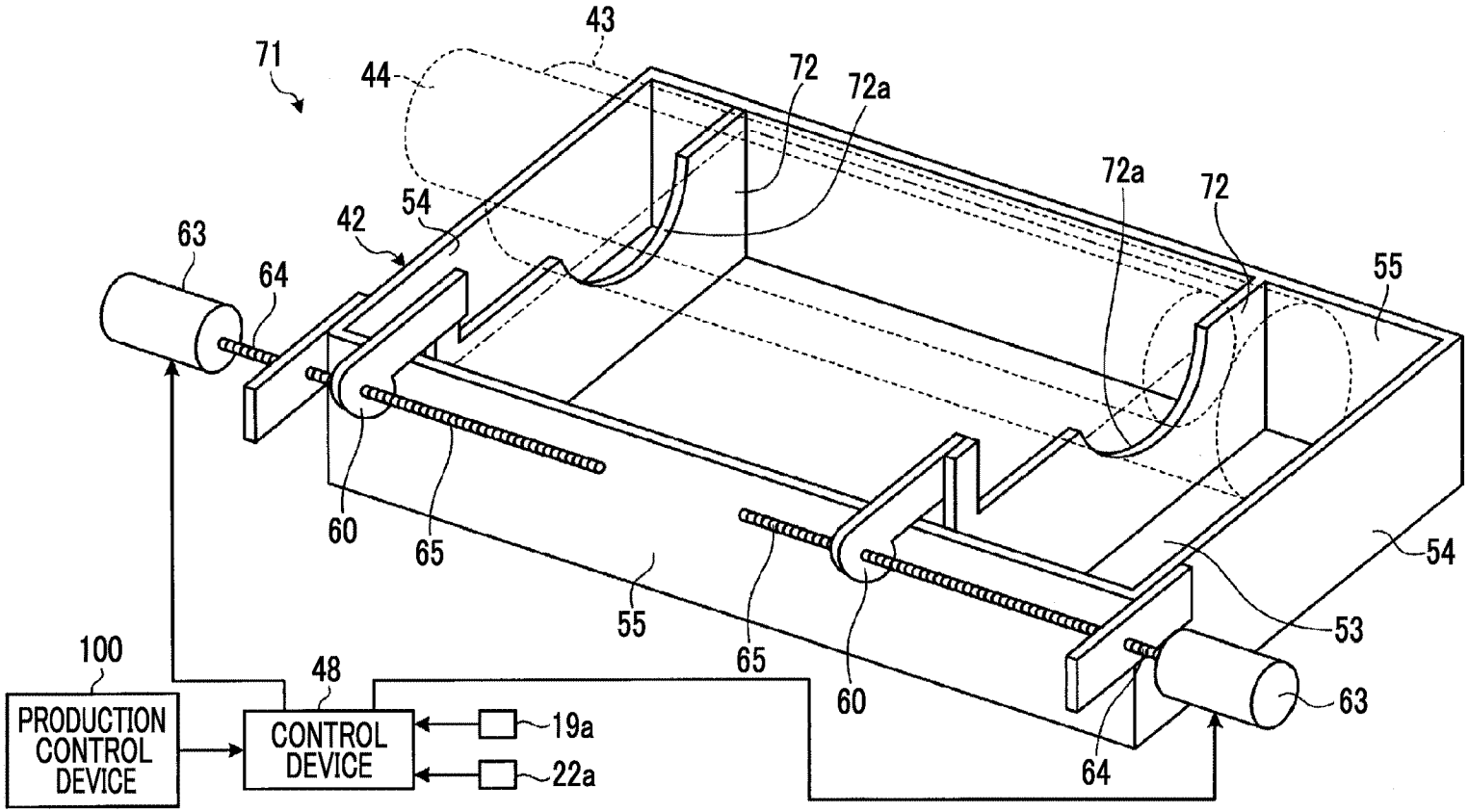
FIG. 6 is a perspective view illustrating another example of the glue application device for corrugated fiberboards related to Embodiment 1 of the invention.

FIG. 6 is a perspective view illustrating another example of the glue application device for corrugated fiberboards related to the present embodiment of the invention. A glue application device 71 illustrated in FIG. 6 can be provided in the above-described glue machine 19 instead of the above-described glue application device 41. The glue application device 71 is different from the above-described glue application device 41 in terms of the configuration of the glue solution regulating members and the regulating member movement mechanism. Therefore, in the description of the glue application device 71, the same portions as those of the above-described glue application device 41 will be designated by the same reference numerals, and the description thereof will be omitted.

The glue application device 71 has a glue dam 72 as a glue solution regulating member and a regulating member movement mechanism that moves the glue dam 72.

The glue dam 72 regulates the adhesion of the glue solution outside the glue application region W on the surface of the glue application roll 43. A pair of the glue dams 72 are formed from resin (plastic, or elastomer), such as urethane, form a flat plate shape, and are provided so as to extend in a direction orthogonal to the axial direction in the glue application roll 43. Each glue dam 72 is disposed inside the glue solution tank 42. The glue solution tank 42 in the glue application device 71 has the bottom plate 53, the pair of side plates 54, and the pair of regulating plate 55 opens upward, and is able to store glue solution therein, and a portion of the glue application roll 43 is able to come into contact with the glue solution and make the glue solution adhere to the surface thereof. The glue dam 72 is provided such that a flat plate-shaped peripheral edge comes into contact with the bottom plate 53 along each regulating plate 55, and is provided so as to stand above the liquid level (illustrated by a two-dot chain line in FIG. 6) of the glue solution stored in the glue solution tank 42. For this reason, the glue solution is dammed by the respective glue dams 72 and is present only between the respective glue dams 72. Additionally, each glue dam 72 has a circular-arc cutout portion 72*a* that comes into contact with a lower surface of the glue application roll 43 in the circumferential direction. A lower region of the cutout portion 72*a* is disposed below the liquid level of the glue solution stored in the glue solution tank 42 together with a portion of the glue application roll 43. For this reason, the glue solution comes into contact with the surface of the glue application roll 43 only between the respective glue dams 72. Therefore, the glue solution adheres to the surface of the glue application roll 43 only between the respective glue dams 72.

The regulating member movement mechanism moves the respective glue dams 72 as the glue solution regulating members in the axial direction of the glue application roll 43 and in the width direction of the glue application region W to be described below. In this regulating member movement mechanism, as illustrated in FIG. 6, the movable plate 60 is attached to the glue dam 72. Additionally, the drive motor 63 is fixed to the glue solution tank 42 or a device frame (not illustrated). In the drive motor 63, the screw shaft 65 supported parallel to the axial direction of the glue application roll 43 is coupled to the driving shaft 64. The screw shaft 65 is screwed to the movable plate 60. Therefore, if the drive motor 63 is driven, the screw shaft 65 can rotate via the driving shaft 64, and the movable plate 60 to which the screw shaft is screwed can be moved along the screw shaft 65. For this reason, the glue dam 72 to which the movable plate 60 is attached can move in the axial direction of the glue application roll 43 to perform positional adjustment.

The glue application device 71 for corrugated fiberboards is controlled by the control device (control unit) 48, similar to the above-described glue application device 41. Therefore, the same effects as in the above-described glue application device 41 can be obtained even in the glue application device 71 for corrugated fiberboards.

Additionally, the corrugating machine 10 as the corrugated fiberboard manufacturing device in the present embodiment is the corrugated fiberboard manufacturing device that sticks the top linerboard (second liner) C onto the corrugating medium B subjected to waveform processing to form the single-faced corrugated fiberboard D, and subsequently, sticks the bottom linerboard A (first liner) onto the corrugating medium B in the single-faced corrugated fiberboard D to form the double-faced corrugated fiberboard E, and is characterized by applying the glue application device 41 or 71 such that the glue solution is made to adhere to the apexes of the waveform of the corrugating medium B.

According to the corrugated fiberboard manufacturing device, the region, which is obtained by adding the specified margins α outside of the side edge locations with the cutting width dimension Wc in the width direction, is set to the glue application region W, on the basis of the cutting width dimension Wc with which the double-faced corrugated fiberboard E is to be cut, and the scraping members 45 or the glue dams 72 are moved so as to regulate the adhesion of the glue solution outside the glue application region W. Thus, the adhesion of the glue solution to the trims that become unnecessary side edges after the double-faced corrugated fiberboard E is cut occurs in only the specified margins α. For this reason, the amount of the glue solution transferred to the trims can be reduced. As a result, a situation where the glue solution is consumed wastefully can be prevented.

Moreover, according to the corrugated fiberboard manufacturing device, when the double-faced corrugated fiberboard E is cut with the cutting width dimension Wc, the portions of the glued specified margins α are cut. For this reason, cutting can be precisely performed by cutting portions with a strong waist by means of glue application.

Embodiment 2

Hereinafter, a glue application device for corrugated fiberboards related to the present embodiment will be described. Here, the glue application device 81 provided in the above-described single facer 15 will be described. The glue application device 81 supplies a glue solution to the respective apexes of the waveform of the corrugating medium B that is stuck on the top linerboard C in order to manufacture the single-faced corrugated fiberboard D.

Figure 7:
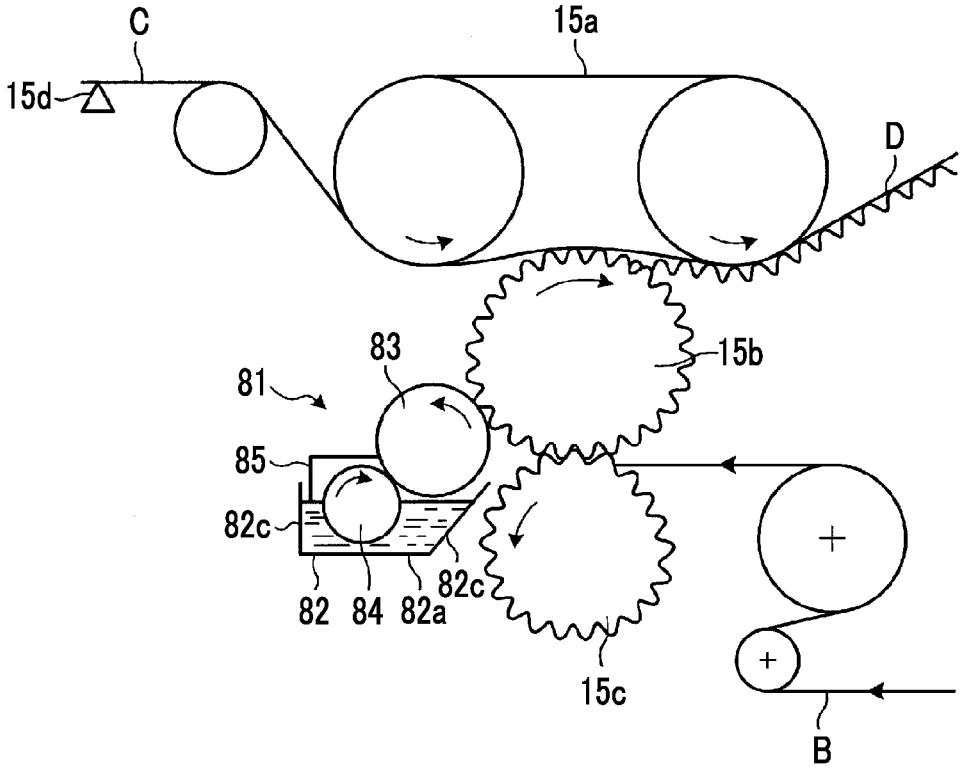
FIG. 7 is a side view illustrating a glue application device for corrugated fiberboards related to Embodiment 2 of the invention.
Figure 8:
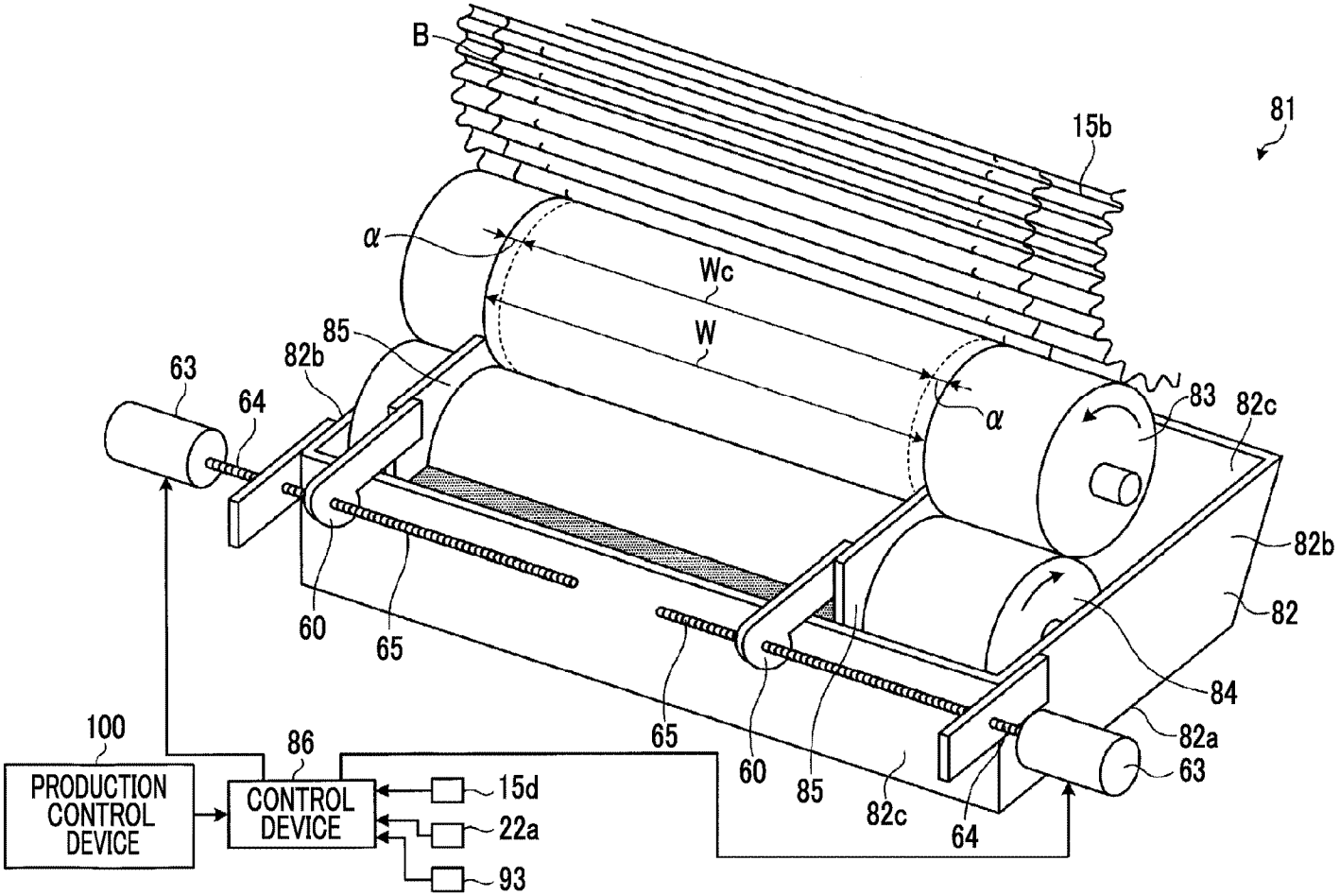
FIG. 8 is a perspective view illustrating the glue application device for corrugated fiberboards related to Embodiment 2 of the invention.

FIG. 7 is a side view illustrating the glue application device for corrugated fiberboards related to the present embodiment, and FIG. 8 is a perspective view illustrating the glue application device for corrugated fiberboards related to the present embodiment.

As described above, the single facer 15 has the pressurization belt 15*a*, the upper stage roller 15*b*, and the lower stage roller 15*c*. The glue application device 81 is disposed in the vicinity of the upper stage roller 15*b*, and is glued to respective apexes of the corrugating medium B that is corrugated in an engagement portion between the upper stage roller 15*b* and the lower stage roller 15*c*.

The glue application device 81 has a glue solution tank 82, a glue application roll 83, a doctor roll 84, and a glue dam (glue solution regulating member) 85.

The glue solution tank 82 has a bottom plate 82*a*, a pair of side plates 82*b*, and a pair of regulating plates 82*c*, opens upward, and enables a glue solution to be stored therein, and a portion of the doctor roll 84 is able to come into contact with the glue solution and adhere the glue solution to the surface thereof.

The glue application roll 83 is a roll that forms a columnar shape, and has respective edges in the axial direction rotatably supported on a device frame by bearings (not illustrated). The doctor roll 84 is a roll that forms a columnar shape, and has respective edges in the axial direction rotatably supported on the device frame by bearings (not illustrated), and a nip portion having a predetermined gap is secured between the doctor roll and the glue application roll 83. The glue application roll 83 is rotatably driven in the counterclockwise direction in FIG. 7 by a drive device (not illustrated), and the doctor roll 84 is rotatably driven in the clockwise direction in FIG. 7. In addition, the doctor roll 84 is supported so as to be capable of being brought closer to and separated from the glue application roll 83, and the amount of nip in the nip portion between the doctor roll and the glue application roll 83 can be adjusted.

Although the rotational axes of the glue application roll 83 and the doctor roll 84 are disposed parallel to each other, the rotational directions of the glue application roll and the doctor roll are opposite directions in the nip portion, and the predetermined gap is secured in the nip portion between both the glue application roll and the doctor roll. Therefore, the glue solution adhering to the surface of the doctor roll 84 is adjusted to a set film thickness in the nip portion, and is made to adhere to the surface of the glue application roll 83. Additionally, although the glue application roll 83 and the upper stage roller 15*b* are disposed such that the rotational axes thereof are parallel to each other, the rotational directions thereof are opposite directions in the nip portion, and the glue solution can be applied on the apexes of the waveform of the corrugating medium B conveyed on the upper stage roller 15*b*.

The glue dam 85 comes into contact with the surface of the doctor roll 84, and the surface of the nip portion of the glue application roll 83 formed together with the doctor roll 84, and regulate the adhesion of the glue solution outside the glue application region W of the corrugating medium B. A pair of the glue dams 85 are formed from resin (plastic, or elastomer), such as urethane, form a flat plate shape, and are provided so as to extend in a direction orthogonal to the axial direction in the glue application roll 83 and the doctor roll 84. Each glue dam 85 is disposed inside the glue solution tank 82. The glue dam 85 is provided such that a flat plate-shaped peripheral edge comes into contact with the bottom plate 82*a* along each regulating member 82*c* of the glue solution tank 82, and is provided so as to stand above the liquid level of the glue solution stored in the glue solution tank 82. For this reason, the glue solution is dammed by the respective glue dams 85 and is present only between the respective glue dams 85. Additionally, each glue dam 85 comes into contact with the surface of the doctor roll 84 and the surface of the nip portion between the doctor roll 84 and the glue application roll 83. For this reason, the glue solution comes into contact with the surface of the doctor roll 84 only between the respective glue dams 85. Therefore, the glue solution adheres to the surface of the doctor roll 84 and the glue application roll 83 only between the respective glue dams 85.

The regulating member movement mechanism moves the respective glue dams 85 as the glue solution regulating members in the axial direction of the doctor roll 84 and in the width direction of the glue application region W to be described below. In this regulating member movement mechanism, as illustrated in FIG. 8, the movable plate 60 is attached to the glue dam 85. Additionally, the drive motor 63 is fixed to the glue solution tank 82 or the device frame (not illustrated). In the drive motor 63, the screw shaft 65 supported parallel to the axial direction of the doctor roll 84 is coupled to the driving shaft 64. The screw shaft 65 is screwed to the movable plate 60. Therefore, if the drive motor 63 is driven, the screw shaft 65 can rotate via the driving shaft 64, and the movable plate 60 to which the screw shaft is screwed can be moved along the screw shaft 65. For this reason, the glue dam 85 to which the movable plate 60 is attached can move in the axial direction of the doctor roll 84 to perform positional adjustment.

The glue application device 81 for corrugated fiberboards is controlled by a control device (control unit) 86. In the corrugating machine 10, as described above, the cutting width dimension Wc of the double-faced corrugated fiberboard E is input to the production control device 100. The control device 86 acquires the cutting width dimension Wc, and sets a region, which is obtained by adding the specified margins α outside of the side edge locations with the cutting width dimension Wc in the width direction on the basis of the cutting width dimension Wc, to the glue application region W. Then, the control device 86 controls the regulating member movement mechanism so as to dispose the glue dams 85 as the glue solution regulating members at the positions corresponding to the side edge locations of the glue application region W. Specifically, the control device 86 drives the drive motor 63 and moves the movable plate 60 in accordance with the set glue application region W, thereby moving the glue dam 85 to a predetermined position. These predetermined positions are positions that coincide with edges of the glue application region W (a width dimension that is wider by the specified margins α to both the side edge sides than the cutting width dimension Wc of the double-faced corrugated fiberboard E cut by the slitter scorer 22).

Namely, the glue application device 81 for corrugated fiberboards in the present embodiment includes the glue solution tank 82 capable of storing a glue solution; the glue application roll 83 capable of making the glue solution in the glue solution tank 82 adhere to a surface thereof and transferring the glue solution to the glue application region W in the width direction of the corrugating medium B forming the single-faced corrugated fiberboard D; the glue dams 85 that regulate the adhesion of the glue solution outside the glue application region W on the surface of the glue application roll 83; the regulating member movement mechanism that moves the glue dams 85 in the width direction of the glue application region W; and the control device 86 that sets the region, which is obtained by adding the specified margins α outside of the side edge locations with the cutting width dimension Wc in the width direction, to the glue application region W, on the basis of the cutting width dimension Wc with which the double-faced corrugated fiberboard E is to be cut after passing through the glue application roll 83 and that controls the regulating member movement mechanism so as to dispose the glue dams at the positions corresponding to the side edge locations of the glue application region W.

Additionally, the glue application method for corrugated fiberboards in the present embodiment includes a step of setting the region, which is obtained by adding the specified margins α outside of the side edge locations with the cutting width dimension Wc in the width direction, to the glue application region W, on the basis of the cutting width dimension Wc with which the double-faced corrugated fiberboard E is to be cut after glue application; a step of arranging the glue dams 85, which regulate the adhesion of the glue solution outside the glue application region W on the surface of the glue application roll 83 that makes the glue solution adhere to the surface of the corrugating medium B forming the single-faced corrugated fiberboard D by being rotated, at the positions corresponding to the side edge locations of the glue application region W; and a step of transferring the glue solution adhering to the surface of the glue application roll 83 onto the surface of the corrugating medium B forming the single-faced corrugated fiberboard D.

According to the glue application device 81 and the glue application method for corrugated fiberboards, since the region, which is obtained by adding the specified margins α outside of the side edge locations with the cutting width dimension Wc in the width direction, is set to the glue application region W, on the basis of the cutting width dimension Wc with which the double-faced corrugated fiberboard E is to be cut, and the glue dams 85 are moved so as to regulate the adhesion of the glue solution outside the glue application region W, the adhesion of the glue solution to the trims that become unnecessary side edges after the double-faced corrugated fiberboard E is cut occurs in only the specified margins α. For this reason, the amount of the glue solution transferred to the trims can be reduced. As a result, a situation where the glue solution is consumed wastefully can be prevented.

Moreover, according to the glue application device for corrugated fiberboards, when the double-faced corrugated fiberboard E is cut with the cutting width dimension Wc, the portions of the glued specified margins α are cut. For this reason, cutting can be precisely by cutting portions with a strong waist by means of glue application.

Meanwhile, as illustrated in FIGS. 7 and 8, the single facer 15 is provided with a side edge detection sensor (side edge detection means) **15*d* that detects the side edge locations of the top linerboard C (the web before the single-faced corrugated fiberboard D is formed) conveyed before being stuck on the corrugating medium B. The side edge detection sensor 15*d* outputs the side edge locations of the detected top linerboard C to the control device 86. Then, the control device 86** acquires the side edge locations of the top linerboard C, thereby controlling the regulating member movement mechanism as follows.

In the above-described embodiment, although the corrugating machine 10 cuts the double-faced corrugated fiberboard E to the cutting width dimension Wc, this cutting may not be performed. In such a case, in the glue application device 81 for corrugated fiberboards, the control device 86 controls the regulating member movement mechanism so as to dispose the glue dams 85 at the positions corresponding to the side edge locations of the top linerboard C acquired from the side edge detection sensor **15*d*. Specifically, the control device 86 drives the drive motor 63 and moves the movable plate 60 in accordance with the acquired side edge locations of the top linerboard C, thereby moving the glue dams 85** to predetermined positions. These predetermined positions are positions that coincide with the side edge locations of the top linerboard C.

Namely, the glue application device 81 for corrugated fiberboards in the present embodiment further includes the side edge detection sensor **15*d* that detects the side edge locations of the top linerboard C (the web before the single-faced corrugated fiberboard D is formed) before being stuck, and when the cutting of the double-faced corrugated fiberboard E is not performed, the control device 86 controls the regulating member movement mechanism so as to dispose the glue dams 85 at the positions corresponding to the side edge locations acquired from the side edge detection sensor 15***d*.

According to the glue application device 81 for corrugated fiberboards, when the cutting of the double-faced corrugated fiberboard E is not performed, the width dimension between both the side edge locations of the top linerboard C before being stuck is set to the glue application region W. Since the glue dams 85 are moved so as to regulate the adhesion of the glue solution outside the glue application region W, glue application can be performed over the entire width dimension of the single-faced corrugated fiberboard D.

In addition, in the present embodiment, when the cutting of the double-faced corrugated fiberboard E is not performed, the control device 86 controls the regulating member movement mechanism so as to dispose the glue dams at the positions corresponding to at the side edge locations of the top linerboard C acquired from the side edge detection sensor 19*a*. However, when there is a change in order, the regulating member movement mechanism may be moved on the basis of the width dimension of the top linerboard C input to the production control device 100.

Additionally, in the above-described embodiment, the corrugating machine 10 cuts the double-faced corrugated fiberboard E to the cutting width dimension Wc, removes the trims that become unnecessary side edges, and sets the specified margins α within the width dimensions of the trims. However, the specified margins α may exceed the width dimensions of the trims. That is, the region, which is obtained by adding the specified margins α outside of the side edge locations with the cutting width dimension Wc in the width direction, may be set to the glue application region W, and the side edge locations of the top linerboard C acquired from the side edge detection sensor 15*d* may be present inside the side edge locations of the glue application region W. Additionally, when the top linerboard C meanders in the width direction and is conveyed in a biased manner, the specified margins α may exceed the width dimensions of the trims. In such a case, in the glue application device 81 for corrugated fiberboards, the control device 86 controls the regulating member movement mechanism so as to dispose the glue dams at the positions corresponding to the side edge locations acquired from the side edge detection sensor 15*d*.

Namely, the glue application device 81 for corrugated fiberboards in the present embodiment further includes the side edge detection sensor 15*d* that detects the side edge locations of the top linerboard C (the web before the single-faced corrugated fiberboard D is formed) before being stuck, and the control device 86 controls the regulating member movement mechanism so as to dispose the glue dams 85 at the positions corresponding to the side edge locations acquired from the side edge detection sensor 15*d* when the side edge locations acquired from the side edge detection sensor 15*d* are present inside the side edge locations of the glue application region W set on the basis of the cutting width dimension Wc.

According to the glue application device 81 for corrugated fiberboards, when the specified margins α cannot be secured within the width dimensions to the trims that become unnecessary side edges after the double-faced corrugated fiberboard E is cut, both the side edge locations of the top linerboard C before being stuck are set to the side edges of the glue application region W. Since the glue dams 85 are moved so as to regulate the adhesion of the glue solution outside the glue application region W, glue application can be performed over the entire width dimension of the double-faced corrugated fiberboard E after cutting.

In addition, when the side edge locations acquired from the side edge detection sensor 15*d* are present inside the side edge locations of the glue application region W set on the basis of the cutting width dimension Wc, the control device 86 controls the regulating member movement mechanism so as to dispose the glue dams 85 at the positions corresponding to the side edge locations acquired from the side edge detection sensor 15*d*. However, when there is a change in order, the regulating member movement mechanism may be moved on the basis of the width dimension of the top linerboard C input to the production control device 100.

In addition, when the side edge locations acquired from the side edge detection sensor 15*d* are present inside the side edge locations of the glue application region W set on the basis of the cutting width dimension Wc, and the specified margins α cannot be secured within the width dimensions of the trims that become unnecessary side edges after the double-faced corrugated fiberboard E is cut, and when the specified margins α can be reduced within the width dimensions of the trims, the control device 86 may reset the glue application region W obtained by subtracting the specified margins α so as to be inside the acquired side edge locations of the top linerboard C, and may control the regulating member movement mechanism so as to dispose the glue dams 85 as the glue solution regulating members at the positions corresponding to the side edge locations of the glue application region W. Even in this way, glue application can be performed over the entire width dimension of the double-faced corrugated fiberboard E after cutting.

Additionally, in the glue application device 81 for corrugated fiberboards in the present embodiment, it is preferable that the cutting width dimension Wc is output from the production control device 100.

According to the glue application device 81 for corrugated fiberboards, glue application to the glue application region W can be reliably performed by appropriately determining the positions of the glue dams 85 on the basis of the information from the production control device 100.

Meanwhile, as illustrated in FIGS. 1 and 8, the glue machine 19 is provided with the after-cutting width dimension detection sensor (after-cutting width dimension detection means) 22*a* that detects an after-cutting width dimension with which the double-faced corrugated fiberboard E is to be cut. The after-cutting width dimension detection sensor 22*a* outputs the detected after-cutting width dimension to the control device 86. The control device 86 acquires the after-cutting width dimension, thereby using the after-cutting width dimension as the cutting width dimension Wc. Specifically, the control device 86 uses the after-cutting width dimension acquired from the after-cutting width dimension detection sensor 22*a* as the cutting width dimension Wc, and sets the region, which is obtained by adding the specified margins α outside of the side edge locations with the cutting width dimension Wc in the width direction on the basis of the cutting width dimension Wc, to the glue application region W. Then, the control device 86 controls the regulating member movement mechanism so as to dispose the glue dams 85 as the glue solution regulating members at the positions corresponding to the side edge locations of the glue application region W.

According to the glue application device 81 for corrugated fiberboards, glue application to the glue application region W can be reliably performed by appropriately determining the positions of the glue dams 85 on the basis of the information from the after-cutting width dimension detection sensor 22*a*.

Figure 9:
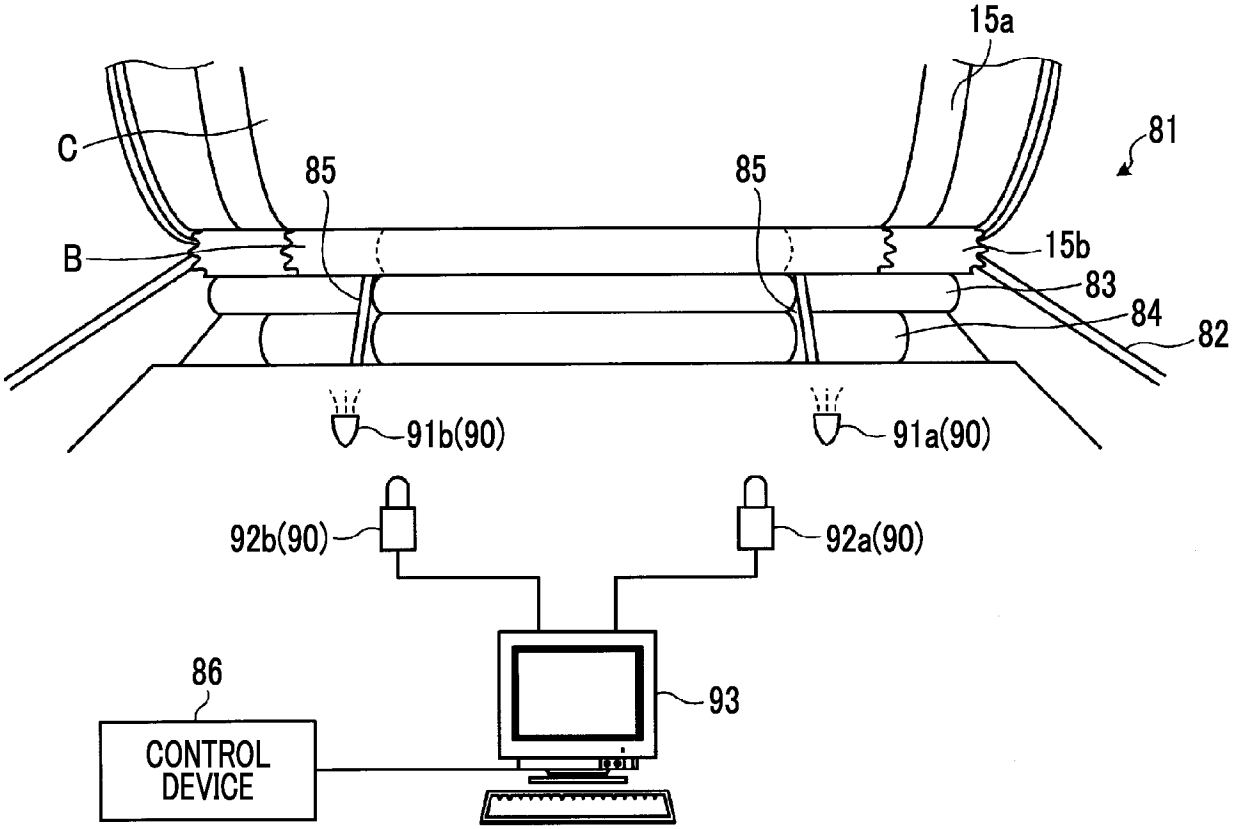
FIG. 9 is a front view illustrating an imaging device and an image processor.

Meanwhile, as illustrated in FIG. 9, the single facer 15 is configured such that the side edge locations of the single-faced corrugated fiberboard D and side edge locations for glue application immediately after the top linerboard C is stuck on the corrugating medium B can be detected. Specifically, the single facer 15 includes an imaging device (imaging means) 90 that images side edge regions of the single-faced corrugated fiberboard D and side edge regions for glue application so as to fall within the same image, and an image processor (image processing means) 93 that process an image captured by the imaging device 90 to detect the side edge locations of the single-faced corrugated fiberboard D and the side edge locations for glue application.

The imaging device 90 has a pair of CCD cameras 91*a* and 91*b*, and a pair of near-infrared ray irradiation devices 92*a* and 92*b*.

The CCD cameras 91*a* and 91*b*, as illustrated in FIG. 9, are disposed at positions where respective side edge regions (respective glue dams 85) for glue solution of the glue application roll 83, respective side edge regions of the corrugating medium B wound around the upper stage roller 15*b* after glue application, and respective side edge regions of the top linerboard C that is located closer to the upstream side than the bonding location stuck on the corrugating medium B and is conveyed by the pressurization belt 15*a* can be seen from above, respectively, above the glue application device 81 and can image the respective regions. The respective CCD cameras 91*a* and 91*b* are disposed at central positions of the movement ranges of the respective glue dams 85. In the respective CCD cameras 91*a* and 91*b*, a polarizing filter is mounted on a camera lens. By using the polarizing filter, imaging can be performed with an image shaded, and the irregular reflection of light can be removed to make the image clear.

The near-infrared ray irradiation devices 92*a* and 92*b* are disposed toward the central positions of the movement ranges of the respective glue dams 85. The respective near-infrared ray irradiation devices 92*a* and 92*b* radiate near infrared rays having a wavelength of 0.7 μm to 2.5 μm.

Here, fine mesh-like irregularities are formed on the surface of the glue application roll 83. By virtue of these fine irregularities, the reflected light of the near infrared rays irradiated on the surface of the glue application roll 83 can be reflected irregularly. Therefore, there is an effect that the reflectivity of the light irradiated on the glue application roll 83 can be reduced. Additionally, a glue dry zone where application has been performed during previous operation, and a glue wet zone where application is performed during current operation are formed on the glue application roll 83. The mesh-like fine irregularities on the surface of the glue application roll 83 have the effect capable of reducing the reflectivity of the reflected light of the near infrared rays irradiated on the glue wet zone.

The imaging device 90 takes in and captures images of the respective glue dams 85, the side edge regions of the corrugating medium B after glue application, and the side edge regions of the top linerboard C before being stuck on the corrugating medium B, using the respective CCD cameras 91*a* and 91*b* into one image, while irradiating the near infrared rays of the above wavelengths from the respective near-infrared ray irradiation devices 92*a* and 92*b*. The captured images in the respective CCD cameras 91*a* and 91*b* of the imaging device 90 are output to an image processor 93.

The image processor 93 obtains the reflectivity of the reflected light of the near infrared rays reflected from the glue application roll 83, and detects a boundary line between the glue wet zone and the glue dry zone on the glue application roll 83 from this reflectivity. If the near infrared rays having the wavelength are radiated to water, the reflectivity deteriorates. Thus, the boundary between the glue dry zone, and the glue wet zone containing moisture can be distinguished by virtue of a difference in this reflectivity from a difference in reflectivity. Since the fine irregularities formed on the surface of the glue application roll 83 further lower the reflectivity of the glue wet zone, the boundary between the glue dry zone and the glue dry zone can be clearly distinguished. This boundary is determined to be a side edge position for a glue solution of the glue application roll 83.

The image processor 93 performs suitable image processing (viewing angle processing, edge processing, binarization processing, gradation processing, or the like) for the captured images in the respective CCD cameras 91*a* and 91*b* of the imaging device 90, and detects the side edge locations of the corrugating medium B and the top linerboard C and the side edge locations for a glue solution of the glue application roll 83.

The control device 86 inputs the operating information (the width of paper, basis weight, web member conveying speeds, the amount of glue, glue dam positions, or the like) of the single facer 15 for every paper replacement or paper splicing from the production control device 100, and calculates the relative deviation amount between the side edge locations of the top linerboard C and the side edge locations for glue application, with the side edge locations of the corrugating medium B as a reference on the basis of the respective side edge locations. The control device 86 controls the regulating member movement mechanism so as to move the glue dams 85 as the glue solution regulating members to positions where the set glue application region W is secured in order to correct this deviation amount.

In addition, although not clearly shown in the drawing, the respective CCD cameras 91*a* and 91*b* may be configured to move with the respective glue dams 85. Additionally, CCD cameras may be separately disposed so as to image the respective side edge regions (respective glue dams 85) for a glue solution of the glue application roll 83, the respective side edge regions of the corrugating medium B wound around the upper stage roller 15*b* after glue application, and the respective side edge regions of the top linerboard C that is located closer to the upstream side than the bonding location stuck on the corrugating medium B and is conveyed by the pressurization belt 15*a*, respectively.

In this way, the glue application device 81 for corrugated fiberboards in the present embodiment includes the imaging device 90 that images the side edge regions of the single-faced corrugated fiberboard D (the corrugating medium B and the top linerboard C) and the side edge regions for a glue solution of the glue application roll 83 at application positions, and the image processor 93 that processes the images captured by the imaging device 90 and detects the side edge locations of the single-faced corrugated fiberboard D (the corrugating medium B and the top linerboard C) and the side edge locations for a glue solution of the glue application roll 83 at application positions, and the control device 86 controls the regulating member movement mechanism so as to move the glue dams 85 to the positions where the set glue application region W is secured on the basis of the respective side edge locations acquired from the image processor 93.

According to the glue application device 81 for corrugated fiberboards, the positions of the glue dams 85 can be appropriately determined on the basis of the side edge locations of the single-faced corrugated fiberboard D (the corrugating medium B and the top linerboard C) and the side edge locations for a glue solution of the glue application roll 83 that are obtained by imaging, and glue application to the glue application region W can be performed reliably.

In addition, the control of the regulating member movement mechanism using the imaging device 90 and the image processor 93 can also be applied to the glue machine of Embodiment 1, though not clearly shown in the drawing. That is, the glue application device 41 or 71 for corrugated fiberboards in Embodiment 1 may includes the imaging device that images the side edge regions of the double-faced corrugated fiberboard E (the corrugating medium B and the bottom linerboard A) and the side edge regions for a glue solution of the glue application roll 43 at application positions, and the image processor that processes the images captured by the imaging device and detects the side edge locations of the double-faced corrugated fiberboard E (the corrugating medium B and the bottom linerboard A) and the side edge position for a glue solution of the glue application roll 43 at application positions, and the control device 48 controls the regulating member movement mechanism so as to move the scraping members 45 or the glue dams 72 to the positions where the set glue application region W is secured on the basis of the respective side edge locations acquired from the image processor 93.

According to the glue application device 41 or 71 for corrugated fiberboards, the position of the scraping members 45 or the glue dams 72 can be appropriately determined on the basis of the side edge locations of the double-faced corrugated fiberboard E (the corrugating medium B and the bottom linerboard A) and the side edge locations for a glue solution of the glue application roll 43 that are obtained by imaging, and glue application to the glue application region W can be performed reliably.

Meanwhile, the glue application device 81 for corrugated fiberboards in the present embodiment is configured such that the adhesion of the glue solution outside the glue application region W on the surface of the glue application roll 83 may be configured to be regulated by the glue dams 85 as the glue solution regulating members, but other configurations may be adopted. For example, although not clearly shown in the drawing, the adhesion of the glue solution outside the glue application region W on the surface of the glue application roll 83 may be regulated by the scraping members described in Embodiment 1 instead of the glue dams 85.

Additionally, the corrugating machine 10 as the corrugated fiberboard manufacturing device in the present embodiment is the corrugated fiberboard manufacturing device that sticks the top linerboard (second liner) C onto the corrugating medium B subjected to waveform processing to form the single-faced corrugated fiberboard D, and subsequently, sticks the bottom linerboard A (first liner) onto the corrugating medium B in the single-faced corrugated fiberboard D to form the double-faced corrugated fiberboard E, and is characterized by applying the glue application device 81 such that the glue solution is made to adhere to the apexes of the waveform of the corrugating medium B.

According to the corrugated fiberboard manufacturing device, since the region, which is obtained by adding the specified margins α outside of the side edge locations with the cutting width dimension Wc in the width direction, is set to the glue application region W, on the basis of the cutting width dimension Wc with which the double-faced corrugated fiberboard E is to be cut, and the glue dams 85 are moved so as to regulate the adhesion of the glue solution outside the glue application region W, the adhesion of the glue solution to the trims that become unnecessary side edges after the double-faced corrugated fiberboard E is cut occurs in only the specified margins α. For this reason, the amount of the glue solution transferred to the trims can be reduced. As a result, a situation where the glue solution is consumed wastefully can be prevented.

Moreover, according to the corrugated fiberboard manufacturing device, when the double-faced corrugated fiberboard E is cut with the cutting width dimension Wc, the portions of the glued specified margins α are cut. For this reason, cutting can be precisely performed by cutting portions with a strong waist by means of glue application.

REFERENCE SIGNS LIST

10: CORRUGATING MACHINE (CORRUGATED FIBERBOARD MANUFACTURING DEVICE)
**15*d***: SIDE EDGE DETECTION SENSOR (SIDE EDGE DETECTION MEANS)
**19*a***: SIDE EDGE DETECTION SENSOR (SIDE EDGE DETECTION MEANS)
**22*a***: AFTER-CUTTING WIDTH DIMENSION DETECTION SENSOR (AFTER-CUTTING WIDTH DIMENSION DETECTION MEANS)
41: GLUE APPLICATION DEVICE
42: GLUE SOLUTION TANK
43: GLUE APPLICATION ROLL
45: SCRAPING MEMBER (GLUE SOLUTION REGULATING MEMBER)
48: CONTROL DEVICE (CONTROL MEANS)
60: MOVABLE PLATE
61: BRACKET
62: SLIDE
63: DRIVE MOTOR
64: DRIVING SHAFT
65: SCREW SHAFT
66: SUPPORTING ARM
71: GLUE APPLICATION DEVICE
72: GLUE DAM (GLUE SOLUTION REGULATING MEMBER)
81: GLUE APPLICATION DEVICE
82: GLUE SOLUTION TANK
83: GLUE APPLICATION ROLL
85: GLUE DAM (GLUE SOLUTION REGULATING MEMBER)
86: CONTROL DEVICE (CONTROL UNIT)
90: IMAGING DEVICE (IMAGING MEANS)
93: IMAGE PROCESSOR (IMAGE PROCESSING MEANS)
100: PRODUCTION CONTROL DEVICE
A: BOTTOM LINERBOARD (FIRST LINER)
B: CORRUGATING MEDIUM
C: TOP LINERBOARD (SECOND LINER)
D: SINGLE-FACED CORRUGATED FIBERBOARD
E: DOUBLE-FACED CORRUGATED FIBERBOARD
P: GLUE SOLUTION
W: GLUE APPLICATION REGION
WC: CUTTING WIDTH DIMENSION
α: SPECIFIED MARGIN

The invention claimed is:

1. A glue application method for corrugated fiberboards comprising:

setting the region, which is obtained by adding specified margins outside of side edge locations with a cutting width dimension in a width direction, to the glue application region, on the basis of the cutting width dimension with which a corrugated fiberboard is to be cut after glue application;

arranging glue solution regulating members, which regulate the adhesion of a glue solution outside the glue application region on the surface of a glue application roll that adheres the glue solution to the surface of a corrugating medium of the corrugated fiberboard by being rotated, at positions corresponding to side edge locations of the glue application region; and transferring the glue solution adhering to the surface of the glue application roll onto the surface of the corrugating medium of the corrugated fiberboard.

2. The glue application method for corrugated fiberboards according to claim 1, further comprising:

detecting, by side edge detection sensor, side edge locations of a web before a corrugated fiberboard is formed; and disposing, when the cutting of the corrugated fiberboard is not performed, the glue solution regulating members at positions corresponding to side edge locations acquired from the side edge detection sensor.

3. The glue application method for corrugated fiberboards according to claim 1, further comprising:

imaging, by imaging device, side edge regions of the corrugated fiberboard and side edge regions for a glue solution of the glue application roll at application positions;

processing, by image processor, images captured by the imaging device and detecting the side edge locations of the corrugated fiberboard and the side edge locations for a glue solution of the glue application roll; and moving the glue solution regulating members to positions where the set glue application region is secured on the basis of the respective side edge locations acquired from the image processor.

4. The glue application method for corrugated fiberboards according to claim 1, wherein the cutting width dimension is output from a production control device.

5. The glue application method for corrugated fiberboards according to claim 1, further comprising:

detecting, by after-cutting width dimension detection sensor, an after-cutting width dimension after the corrugated fiberboard is cut; and moving the glue solution regulating members, using the after-cutting width dimension acquired from the after-cutting width dimension detection sensor as the cutting width dimension.

6. The glue application method for corrugated fiberboards according to claim 1, further comprising:

detecting, by side edge detection sensor, side edge locations of the corrugated fiberboard before being stuck; and disposing, when the side edge locations acquired from the side edge detection sensor are inside the side edge locations of the glue application region set on the basis of the cutting width dimension, the glue solution regulating members at positions corresponding to the side edge locations acquired from the side edge detection sensor.

* * * * *